United States Patent [19]

Kogure et al.

[11] Patent Number: 4,857,908

[45] Date of Patent: Aug. 15, 1989

[54] WIDE SCREEN DISPLAY DEVICE USING AN ENDLESS BELT

[75] Inventors: Masaaki Kogure; Yoshihiro Mitekura; Naoki Matsuyama, all of Tokyo; Satoshi Shinguryo, Kawaguchi, all of Japan

[73] Assignee: Ricoh Company, Ltd., Tokyo, Japan

[21] Appl. No.: 265,349

[22] Filed: Oct. 28, 1988

Related U.S. Application Data

[63] Continuation of Ser. No. 9,992, Feb. 2, 1987, abandoned.

[30] Foreign Application Priority Data

| | | | |
|---|---|---|---|
| Jan. 31, 1986 | [JP] | Japan | 61-19742 |
| Feb. 7, 1986 | [JP] | Japan | 61-23676 |
| Aug. 14, 1986 | [JP] | Japan | 61-191501 |
| Aug. 15, 1986 | [JP] | Japan | 61-190610 |
| Aug. 21, 1986 | [JP] | Japan | 61-196525 |

[51] Int. Cl.[4] ..... G09G 3/26

[52] U.S. Cl. ..... 340/785; 340/792; 340/809; 340/810

[58] Field of Search ..... 340/785, 783, 702, 786, 340/789, 793, 809, 810, 815.01, 815.1, 781, 792; 350/354, 357, 360, 361, 363

[56] References Cited

U.S. PATENT DOCUMENTS

| | | | |
|---|---|---|---|
| Re. 28,199 | 10/1974 | Deb et al. | 340/785 |
| 3,260,798 | 12/1966 | Campbell et al. | 350/361 |
| 3,958,235 | 5/1976 | Duffy | 340/755 |
| 4,438,453 | 3/1984 | Alston | 340/703 |
| 4,496,946 | 1/1985 | Pera | 340/810 |
| 4,547,787 | 10/1985 | Kaneko et al. | 340/783 |
| 4,574,281 | 3/1986 | Moriguchi et al. | 340/783 |
| 4,577,098 | 3/1986 | Ogawa | 350/354 |
| 4,626,920 | 12/1986 | Glenn | 350/360 |
| 4,636,987 | 1/1987 | Kishi | 340/810 |
| 4,650,288 | 3/1987 | White | 340/787 |
| 4,680,459 | 7/1987 | Drexler | 350/361 |
| 4,680,579 | 7/1987 | Ott | 340/810 |

*Primary Examiner*—Gerald L. Brigance
*Assistant Examiner*—M. Fatahiyar
*Attorney, Agent, or Firm*—Oblon, Spivak, McClelland, Maier & Neustadt

[57] ABSTRACT

An image display device in which image data produced by an image scanner separate from the display may be written and erased. The display consists of a movable endless belt. Four embodiments are shown with the belt being made of an electrochromic material which electrochemically shows oxidation-reduction reactions; an optically reversible photochromic material; a thermoplastic sheet produced by applying a photoconductor and a thermoplastic resin to a transparent conductive film; and a color photochromic sheet made up of a photochromic film whose absorption changes when illuminated by light of predetermined wavelengths and a repetitive sequence of color filters of red, green and blue each being formed in a stripe configuration, respectively. Visible images are displayed on the display member based on the image data.

10 Claims, 20 Drawing Sheets

126a

| | | | | | | | | | |
|---|---|---|---|---|---|---|---|---|---|
| A-10 | A-9 | A-8 | A-7 | A-6 | A-5 | A-4 | A-3 | A-2 | A-1 |
| B-10 | B-9 | B-8 | B-7 | B-6 | B-5 | B-4 | B-3 | B-2 | B-1 |

WIDE SCREEN DISPLAY DEVICE USING AN ENDLESS BELT

This application is a continuation of application Ser. No. 009,992, filed on Feb. 2, 1987, now abandoned.

BACKGROUND OF THE INVENTION

The present invention relates to an image display device for displaying images which uses a display member in which image data may be written and erased.

One typical approach for wide screen displaying of a document in which characters and graphics are printed is duplicating the document on a transparent film (for use with an overhead projector of OHP) and projecting it onto a screen in an enlarged scale. Another typical approach is photographing the document by use of a reversal film or slide film and projecting it onto a screen in an enlarged scale.

Such traditional approaches have various drawbacks as follows:

(1) When the screen size is increased, the luminous intensity is lowered to render information displayed illegible;

(2) Because the room has to be darkened during the display, it is hard for one to look at documents at hand;

(3) The use of an OHP results in an extra period of time necessary for the preparation of the special sheet; and (4) The use of a slide projector also increases the period of time and cost required because the special slide film is indispensable. An optical wide screen display device of any of the above-described types is contradictory to the current trend toward office automation.

Meanwhile, in a conference and other occasions where a number of attendance are expected to look at the same information presented or discussed, a blackboard is used quite often as an information transmitting medium. A recent achievement in the realm of display art is an electronic display device, or so-called electronic blackboard, which solves various problems inherent in an ordinary blackboard such as that it cannot preserve information written thereon.

However, an electronic display device presently available is no more than an implementation which allows information to be written by a pen instead of a piece of chalk and, if desired, allows it to be reproduced in a hard copy. That is, information cannot be displayed on the device unless written by hand just as in an ordinary blackboard, so that the device fails to meet the need for multiple functions.

SUMMARY OF THE INVENTION

It is therefore an object of the present invention to provide a multi-function image display device which uses a writable and erasable display member and allows information to be displayed on a large screen.

It is another object of the present invention to provide an image display device capable of directly displaying on a wide screen information which has been read by an image reader.

It is another object of the present invention to provide a generally improved image display device.

In accordance with the present invention, there is provided an image display device comprising a display member made of an electrochromic material which electrochemically shows oxidation-reduction reactions, the display member allowing information to be written and erased therein, writing means for writing information in the display member, and erasing means for erasing information which is written in the display member.

In accordance with the present invention, there is also provided an image display device comprising a display member made of a photochromic material which is optically reversible, the display member allowing information to be written and erased therein, writing means for writing information in the display member, and erasing means for erasing information which is written in the display member.

In accordance with the present invention, there is also provided an image display device comprising a thermoplastic sheet consisting of a transparent conductive film, and a photoconductor and a thermoplastic resin which are applied to the film, charging means for depositing a uniform charge on the sheet, illuminating means for selectively illuminating the sheet charged by the charging means in response to an image signal which is fed from the outside, AC charging means for neutralizing the charge in unexposed portions of the film by AC charge, developing means for heating the sheet, the unexposed portions of which have been neutralized by the AC charging means, so as to produce images due to deformative distortions which correspond to the image signal, cooling means for cooling the sheet with the images formed therein so as to fix the images, image displaying means for displaying frost images by illuminating the sheet, and erasing means for erasing the frost images by heating the sheet after the images have been displayed.

In accordance with the present invention, there is also provided an image display device comprising a color photochromic sheet consisting of a photochromic film absorption which changes in response to light having predetermined wavelengths, and a repetitive sequence of color filters of red, green and blue which are provided on the photochromic film each in a stripe configuration, illuminating means for selectively illuminating the respective filters of the sheet by light having predetermined wavelengths on a pixel basis in response to an image signal, thereby forming images which are different in absorption from each other, image displaying means for displaying the images formed in the sheet as color images by illuminating the sheet, and erasing means for erasing the images by heating the sheet after the images have been displayed.

The above and other objects, features and advantages of the present invention will become more apparent from the following detailed description taken with the accompanying drawings.

DESCRIPTION OF THE PREFERRED EMBODIMENTS

Figure 1:
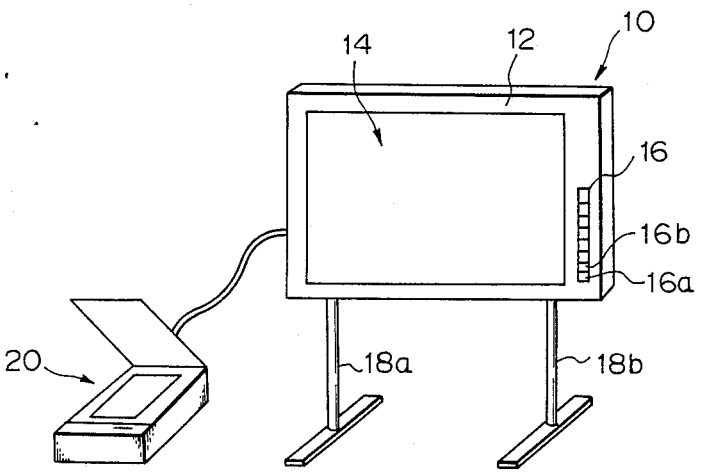
FIG. 1 is a perspective view of an display device embodying the present invention.

Referring to FIG. 1 of the drawings, an image display device embodying the present invention is shown and generally designated by the reference numeral 10. The device 10 includes a frame 12 which is provided at its front with a display surface 14 for displaying and writing images thereon. The display surface 14 is constituted by a display belt which will be described. The device 10 also includes a control panel 16 on which are arranged a start switch 16*a* adapted to command a movement of the display surface 14, a slide volume type density control switch 16*b*, etc. The device 10 is supported on a floor by legs 18*a* and 18*b*. An image scanner 20, for example, is connected to the device 10 in order to read and output information which is printed on a document or the like.

Figure 3:
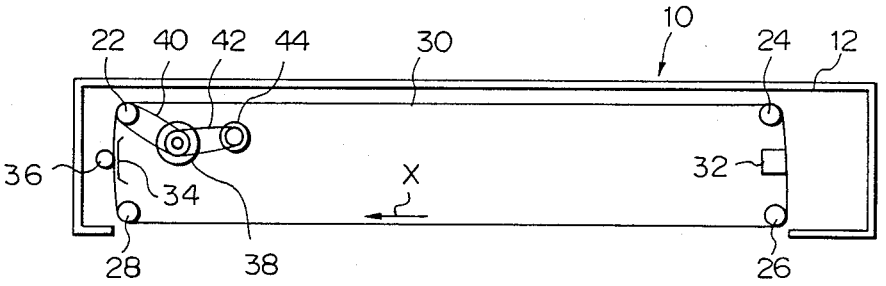
FIG. 3 is a schematic view of the internal arrangement of the device as shown in FIG. 1.
Figure 4:
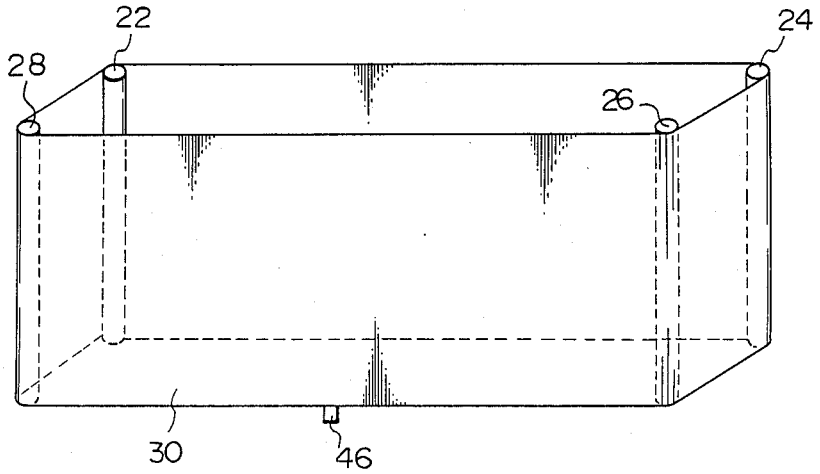
FIG. 4 is a perspective view of a display belt.

FIG. 3 schematically shows the internal construction of the display device 10. As shown, a drive roller 22 and idler rollers 24, 26 and 28 are rotatably disposed at the four corners inside of the frame 12. An endless display belt 30 which serves as a display member is passed over the rollers 22, 24, 26 and 28, as also shown in FIG. 4.

Figure 5:
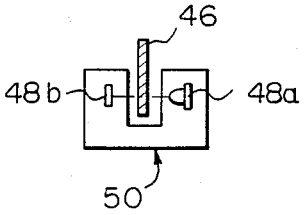
FIG. 5 is a view of a home sensor.

A write head 32 for writing information on the display belt 30 is located between the idler rollers 24 and 26 and inside of the display belt 30. An erase head 34 for erasing information on the display belt 30 is located between the idler roller 28 and the drive roller 22 and inside of the belt 30, while a pressure roller 36 is positioned to cooperate with the head 34 with the intermediary of the belt 30. The drive roller 22 is driven by a stepping motor or like motor 38 through a belt 40 so as to move the belt 30 in a direction indicated by an arrow X. An encoder 44 is connected to the motor 38 by a belt 42. As shown in FIG. 4, two light intercepting pieces (only one is shown) 46 extend downward from the bottom edge of the display belt 30 in order to sense, respectively, the home positions of two display surfaces of the belt 30. As shown in FIG. 5, a home sensor 50 cooperates with each of the pieces 46 and consists of a light emitting element 48*a* and a light-sensitive element 48*b* which face each other.

Figure 6:
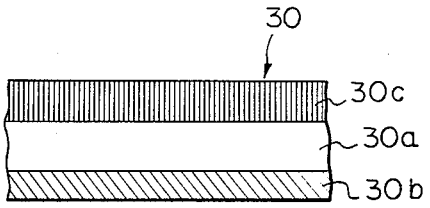
FIG. 6 is a view representative of a laminate structure of the display belt.

As shown in FIG. 6, the display belt 30 is made up of a first layer 30*a* made of an electrochromic material, a transparent second layer 30*b* laminated on one surface of the first layer 30*a* to serve as a common electrode base, and a third layer 30*c* laminated on the other surface of the first layer 30*a* and provided with signal electrodes which face the common electrode base. The display belt 30 is flexible.

The first layer 30*a* is produced by doping an electrochromic (EC) material which electrochemically shows oxidation-reduction reactions in a perimeric film which is capable of becoming ion-conductive. The porimeric film is deposited on the second layer 30*b*. In this particular embodiment, the EC material comprises a mixture of several kinds of EC materials. Typically, the EC materials may be selected from organic EC materials such as dipyridil derivative, benbuil derivative and polymerized tetratiaclebalen, and inorganic EC materials such as metavanadate, polytungstate, phosphorus wolframate, AgI, WOx, MOOx, Ni(OH)X and $TiO_2$. A binder for such a mixture may comprise methyl cellulose, ethyl cellulose, carboxymethyl cellulose and other cellulose derivatives, polyvinyl alcohol, polyvinyl butyralr, polyacryl or polymethacryl resins, polystyren resins, polyamid, urea resins and other synthetic resins.

Figure 9:
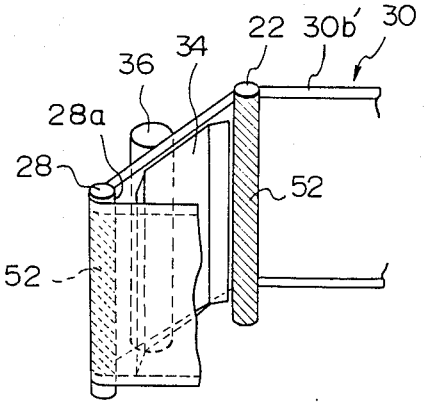
FIG. 9 is a perspective view of an erase head.

The second layer 30*b* consists of an elastic substrate of polyester or the like, and a layer of $In_2O_3$, $SnO_2$ or the like provided on the elastic substrate by vacuum deposition or plating. That surface of the layer 30*b* which is opposite to the first layer 30*a* is so processed as to allow information to be written thereon by a pen or like implementation. To define a plurality of, such as two, display areas on the display belt 30, the second layer 30*b* is divided into a plurality of areas by insulating members (not shown) and, as shown in FIGS. 7 and 9, provided with strip-like common electrode terminals 30*b'* at both sides thereof.

Further, the third layer 30*c* is produced by dispersing metal fibers in a polymer such as polyethylene or polypropyrene and is conductive in the vertical direction only, i.e., it is insulative in the horizontal direction. The metal fibers may be implemented with Au, Ti, Pt or plated metal fibers. A pigment whose color may be, but not limited to, white is added to the third layer 30*c* so that the latter may constitute the background.

When a voltage of several volts, for example, is applied across the third and second layers 30*c* and 30*b*, i.e., signal and common electrodes of the display belt 30, only those portions of the first layer 30*a* to which the voltage is applied become colored and can be recognized through the second layer 30*b*. Even after the voltage has been interrupted, the pattern on the belt 30 is preserved due to the memorizing property of the EC material which constitutes the layer 30*a*. In this particular embodiment the laminate structure of the display belt 30 is such that information written in the third layer 30*c* is visible from the second layer 30*b* side. Hence, the display belt 30 is passed over the rollers 22, 24, 26 and 28 with the third layer 30*c* facing inward and the second layer 30*b* facing outward.

Figure 7:
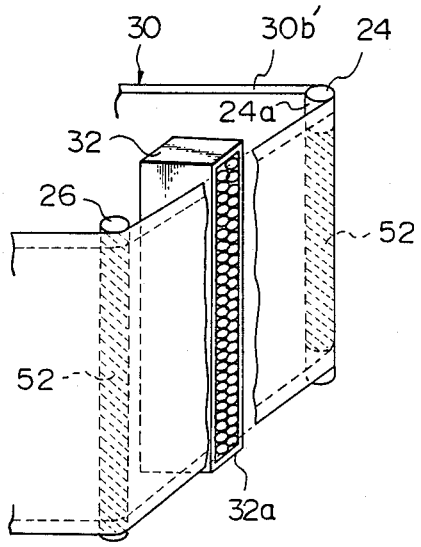
FIG. 7 is a perspective view of a write head.
Figure 8:
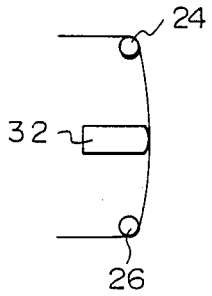
FIG. 8 is a view showing a location of the write head.

As shown in FIG. 7, the write head 32 comprises two arrays of needle electrodes 32*a* each extending in the widthwise direction of the display belt 30 and offset from the other in a zig-zag fashion. The nearby electrodes 32*a* are insulated from each other by a polymeric resin or any other suitable material. Each electrode 32*a* may have a diameter of one to several millimeters, which is enough for a sufficient degree of resolution to be achieved. As shown in FIG. 8, the write head 32 is somewhat protruded beyond the plane which interconnects the rollers 24 and 26, whereby it is allowed to make sure contact with the display belt 30. A predetermined voltage is selectively applied to the electrodes 32*a* of the head 32 so as to write information in the display belt 30.

As shown in FIG. 9, the erase head 34 is in the form of a flat electrode both ends of which are bent to insure smooth transport of the display belt 30. The pressure roller 36 is located to face the erase head 34 with the intermediary of the display belt 30; information written in the belt 30 is erased when the EC material of the belt 30 is pressed with a voltage opposite to a write voltage applied thereto. An anti-slip member 52 is wrapped around each of the rollers 22, 24, 26 and 28 as indicated by hatching in FIGS. 7 and 8, so that the friction coefficient of the roller may be enhanced to prevent the display belt 30 from slipping. However, the member 52 is not provided on those portions of the idler rollers 24 and 28 which make contact with the common electrode terminals 30*b'* on opposite sides of the belt 30, i.e., those portions are left bare to constitute electrode portions 24*a* and 28*a*. These electrode portions 24*a* and 28*a* are used to apply a write and an erase voltage to the second layer, or common electrode, 30*b* of the belt 30.

Figure 10:
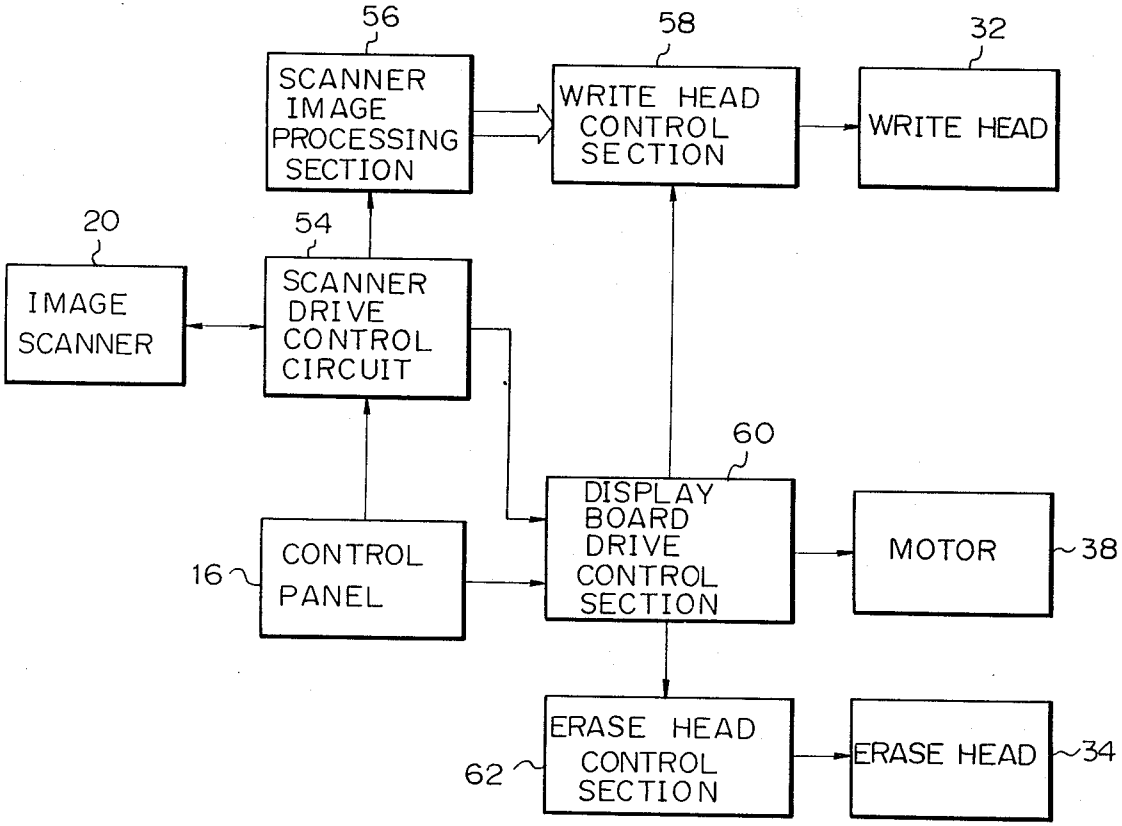
FIG. 10 is a block diagram showing a specific construction of a control section.

Referring to FIG. 10, a control section of the display device 10 is shown in a block diagram. The control section includes a scanner drive control circuit 54 which, when the start switch 16*a* on the control panel 16 is depressed, controllably drives the image scanner 20, information read by the scanner being fed to a scanner image processing section 56. In response, the processing section 56 performs density conversion and other kinds of image processing on the input information to match it to the particular size of the display area on the belt 30. The output of the processing section 56 is applied to a write head control section 58, which will be described. A display board drive control section 60 responds to a scanner start signal, which is fed thereto from the control circuit 54, by driving the motor 38 at a rate associated with a particular density which is selected by the switch 16*b* on the control panel 16. At the same time, the control section 60 delivers a write timing signal and an erase timing signal to the write head control section 58 and an erase head control section 62, respectively, each at a predetermined timing. Upon reception of the timing signal from the control section 60, the write head control section 58 selectively applies a write voltage to the electrodes 32*a* of the write head 32 in response to image data which are fed thereto from the processing section 56, whereby images read by the image scanner 20 are written in the belt 30. The erase head control section 62, on the other hand, responds to the timing signal from the control section 60 by applying an erase voltage to the erase head 34 so as to erase images in the display belt 30.

Figure 11:
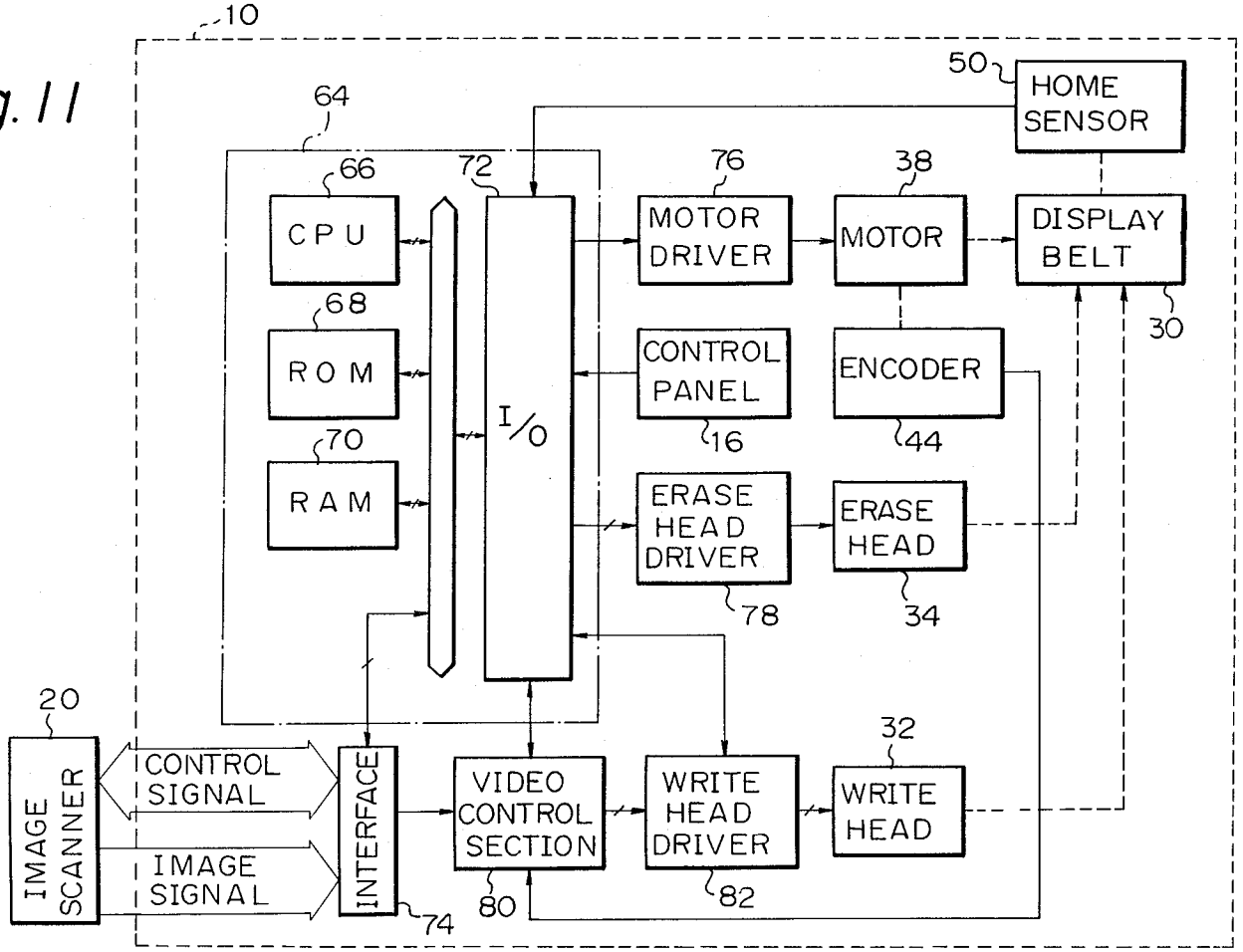
FIGS. 11, 12 and 13 are block diagrams showing practical examples of the control section.

Referring to FIG. 11, a specific construction of the control section is shown in a block diagram. As shown, the control section includes a microcomputer system 64 which is made up of a CPU (microprocessor) 66, a ROM 68, a RAM 70, and an I/O 72. The system 64 controls the entire display device 10 in response to the outputs of the home sensors 50, statuses of the switches 16*a* and 16*b*, a control signal fed thereto from the image scanner 20 via an interface 74, and others. Specifically, the system 64 drives the motor 38 via a motor driver 76 to move the display belt 30, controls an erase head driver to apply an erase voltage to the erase head 34 to thereby erase information in the display belt 30, controls a video control section 80 and a write head driver 82, and delivers a control signal to the image scanner 20 via the interface 74.

The signals interchanged between the display device 10 and the image scanner 20 are generally classified into control signals and image signals. The control signals comprise various commands such as a write start command which are fed from the image scanner 20 to the device 10, and status signals delivered from device 10 to the image scanner 20 to show various statuses of the device 10. The image signal, on the other hand, consists of binary image data S-DATA representative of whether an image read is white or black (0, 1), a line sync signal S-LSYNC generated every time one line of images are read, and a strobe signal S-STROB for delivering image data S-DATA to the display device 10. The status signals to be fed from device 10 to the image scanner 20 comprise a ready signal READY which shows that the device 10 is ready to accept a command signal, and a busy signal BUSY which shows that it is writing images. When the device 10 is in a READY status, it starts displaying images on the belt 30 in response to a write start command which may be delivered thereto from the image scanner 20.

Figure 12:
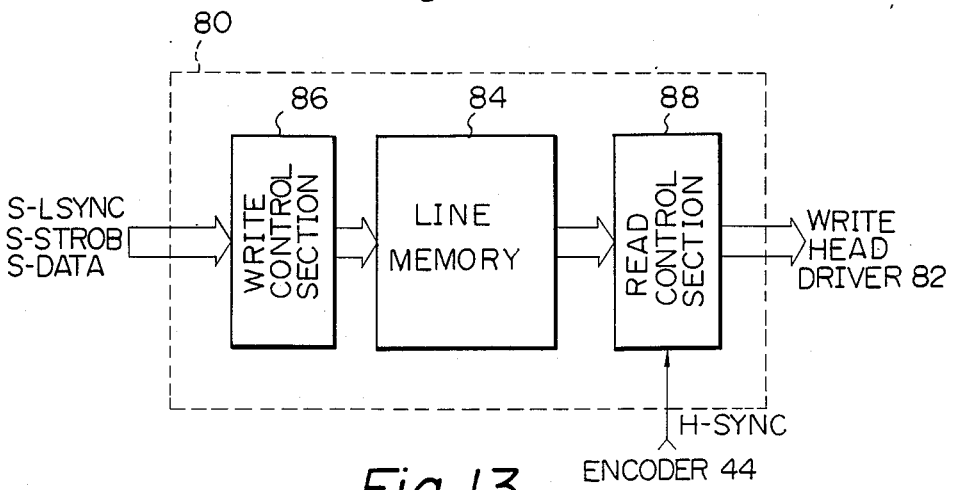

The image signal from the image scanner 20 is applied to the video control section 80 via the interface 74. Then, the video control section 80 converts the image signal into write data to be written in the display belt 30. The write data are routed to the write head 32 via the write head driver 82 so as to write the images in the belt 30. As shown in FIG. 12, the video control section 80 consists of a line memory 84 for storing image data, a write control section 86 for controlling the storage of image data into the line memory 84, and a read control section 88 for controlling read-out of image data.

The line memory 84 is implemented with a plurality of shift registers or like line memories and constructed to store image data by serial-to-parallel conversion. The number of line memories which constitute the line memory 84 is equal to the number of lines of the image data S-DATA which are fed from the image scanner 20 from the instant when image data S-DATA are begun to be stored to the instant when the image data stored are read out in synchronism with the image writing rate into the belt 30. The write control section 86 selects any one of the line memories 84 in response to a line sync signal S-LSYNC from the image scanner 20 and, then, sequentially stores image data S-DATA timed to a strobe signal S-STROB. The encoder 44 produces a sync signal H-SYNC in synchronism with the transport of the belt 30, the signal H-SYNC being applied to the read control section 88. In response, the read control section 88 reads data out of the line memories 84 the oldest one first and delivers them to the head driver 82. It is to be noted that the pulse interval of the sync signal H-SYNC is equal to a period of time which is necessary for the belt 30 to move the distance between nearby lines in the subscanning direction (moving direction of the belt 30).

Figure 13:
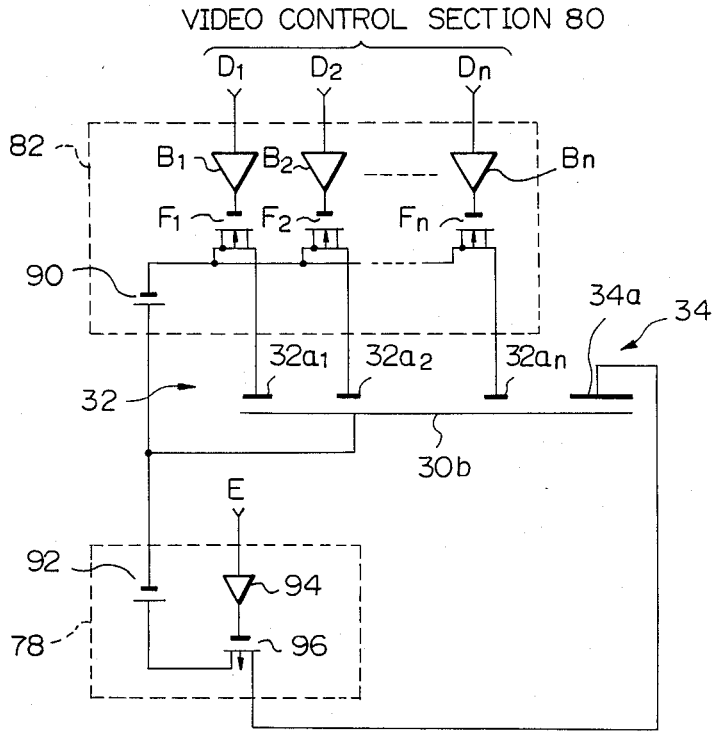

As shown in FIG. 13, the write head driver 82 comprises a write power source 90 assigned to n (one array) of needle electrodes $32a_1$ to $32a_n$ of the write head 32, buffers $B_1$ to $B_n$ for inputting write data (image data) $D_1$ to $D_n$ from the video control section, and n-MOS field effect transistors (FET) $F_1$ to $F_n$ which are associated with the buffers $B_1$ to $B_n$, respectively. The FETs $F_1$ to $F_n$ are adapted to turn on and off the write voltage which is applied to the electrodes $32a_1$ to $32a_n$ of the write head 32. When video data $D_n$ (n=1 to n) output from the video control section 80 is a ONE, the output of the FET $F_n$ (n=1 to n) assumes a high impedance (OFF state) to prevent the voltage of the power source 90 from being applied across the common electrode (second layer) 30b and the needle electrode $32a_n$ (n=1 to n) of the write head 32, i.e., signal electrode (third layer) 30c. Conversely, when the image data $D_n$ (n=1 to n) is a ONE, the FET $F_n$ (n=1 to n) is turned ON to allow the voltage from the power source 90 to be applied across the common electrode (second layer) 30b and the electrode $32a_n$ (n=1 to n) of the write head 32, i.e. signal electrode (third layer) 30c. This causes those portions of the belt 30 to which the voltage is applied to color and, thereby, reproduces images which have been read by the image scanner 20 on the belt 30. It will be noted that because two arrays of needle electrodes 32a are arranged in the write head 32, two identical arrangements of the above-stated structural elements are built in the write head driver 82 and switched from one to the other by an output signal of the microcomputer system 64, the two discrete identical arrangements sharing the power source 90.

As shown in FIG. 13, the erase head driver 78 is made up of an erase power source 92 assigned to the erase electrode 34a of the erase head 34, a buffer 94 for inputting an erase drive pulse E output from the microcomputer system 64, and a p-MOS FET 96 to which the output of the buffer 94 is applied to turn ON and OFF the erase voltage for the erase electrode 34a. When the erase drive pulse E becomes high level, the FET 96 is turned ON to feed the erase voltage (positive voltage) to the erase electrode 34a, thereby erasing information on the display belt 30.

The display device 10 having the above construction will be operated as follows. First, the operation will be outlined with reference to FIG. 10.

Figure 2:
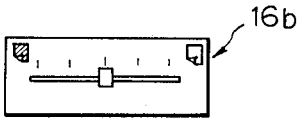
FIG. 2 is a plan view of a density control switch which is provided on the device of FIG. 1.

In the initial condition, one of two display areas of the belt 30 is so positioned as to constitute as the display surface 14 of the device 10. As a person depresses the start switch 16a on the control panel 16, the display board drive control section 60 drives the motor 38 at a rate corresponding to a particular density selected by the switch 16b. The motor 38 in turn feeds the belt 30 as indicated by the arrow X in FIG. 2, causing the above-mentioned display area to enter the frame 12. In the meantime, the erase head control section 62 responds to a timing signal from the control section 60 by applying the erase voltage to the erase head 34 and, thereby, erasing information which is present in the display area. At the same time, the image scanner 20 begins to scan a document or the like to read images thereoutof, and the resulting image data are processed by the image processing section 56 to be fed to the write head control section 58.

Upon reception of the timing signal from the control section 60, the write head control section 58 selectively applies the write voltage to the needle electrodes 32a of the write head 32 based on the image data, whereby the images read out are sequentially written in the display belt 30. As soon as the other display area of the belt 30 is brought into alignment with the display surface 14 of the device 10, the control section 60 deenergizes the motor 38 and, thereby, the belt 30. In this condition, both of the second layer or common electrode 30b and the third area or write and erase electrode 30c are grounded. In this manner, the images read by the image scanner 20 are displayed on the surface 14 of the device 10.

Next, the operation of the control section as shown in FIG. 11 will be explained with reference also made to FIGS. 15 and 16A to 16F.

Figure 14:
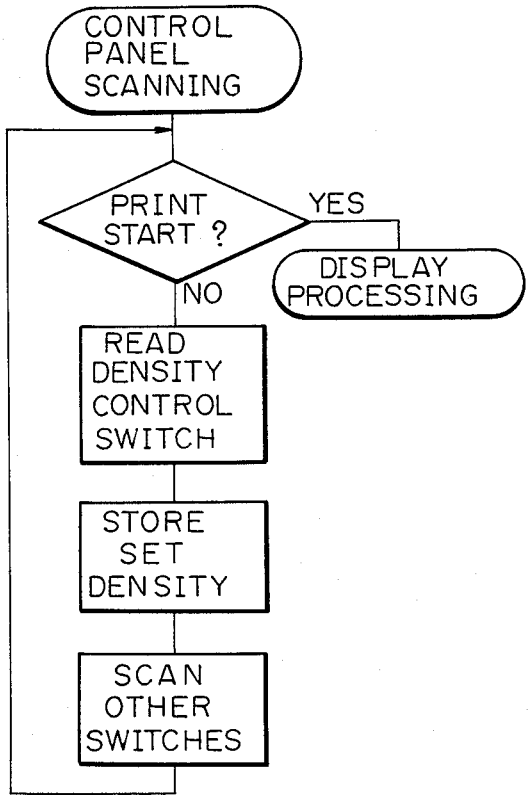
FIG. 14 is a flowchart showing control panel scanning processing.
Figure 15:
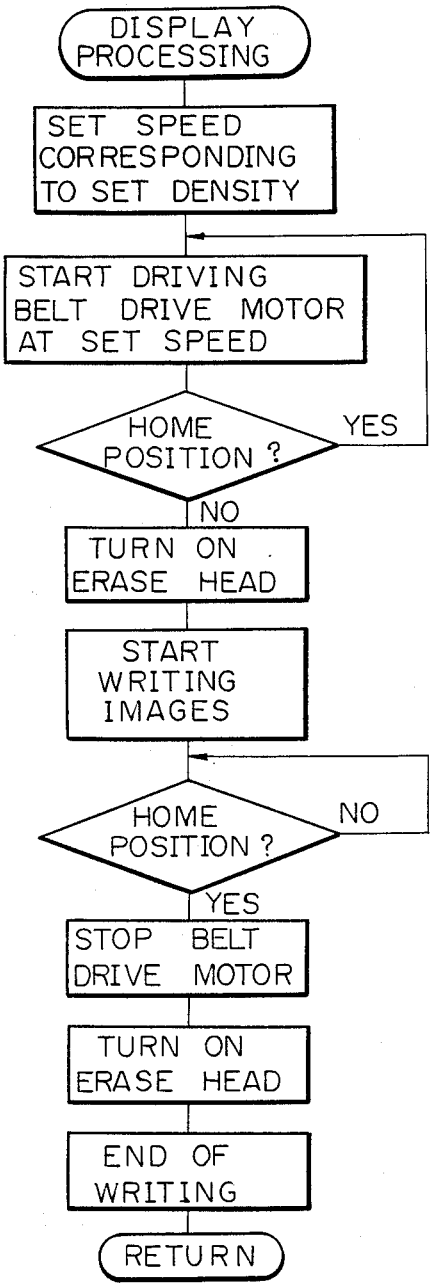
FIG. 15 is a flowchart showing display processing.

First, referring to FIG. 14, control panel scanning processing is shown which is performed by the microcomputer system 64 for monitoring the statuses of switches on the control panel 16. The procedure begins with deciding whether the start switch 16a has been depressed or not. If the result is YES as shown in FIG. 14, the program advances to display processing which will be described. If the result is NO, the system 64 fetches the status of the density control switch 16b and converts it into a specified density and, after storing it as a selected density in a predetermined area of its RAM, scans the other switches.

As shown in 15, in the display processing, a particular rate of movement of the belt 30 which corresponds to the selected density as stored in the RAM during the control panel scanning processing is set and, then, the motor 38 is driven to start moving the belt 30. In this instance, either one of the two display areas of the belt 30 is located to constitute the display surface 14, as previously stated. That is, in the initial condition, the belt 30 is maintained in its home position. In this condition, whether the output of the home sensor 50 is still at a low or "L" leel, i.e., whether the belt 30 is in the home position is decided. If it is not in the home position, i.e., if the belt 30 has already begun to move, an erase drive pulse is fed to the erase head driver 78 to apply the erase voltage to the erase head 34 (erase head ON). Then, the erase head 34 erases images which are written in the one display area of the display surface 14. Thereafter, the status signal fed to the image scanner 20 is changed from the BUSY state to the READY state, allowing images to be written in the other display area which has not constituted the display surface 14.

Figures 16A, 16B, 16C, 16D, 16E, 16F:
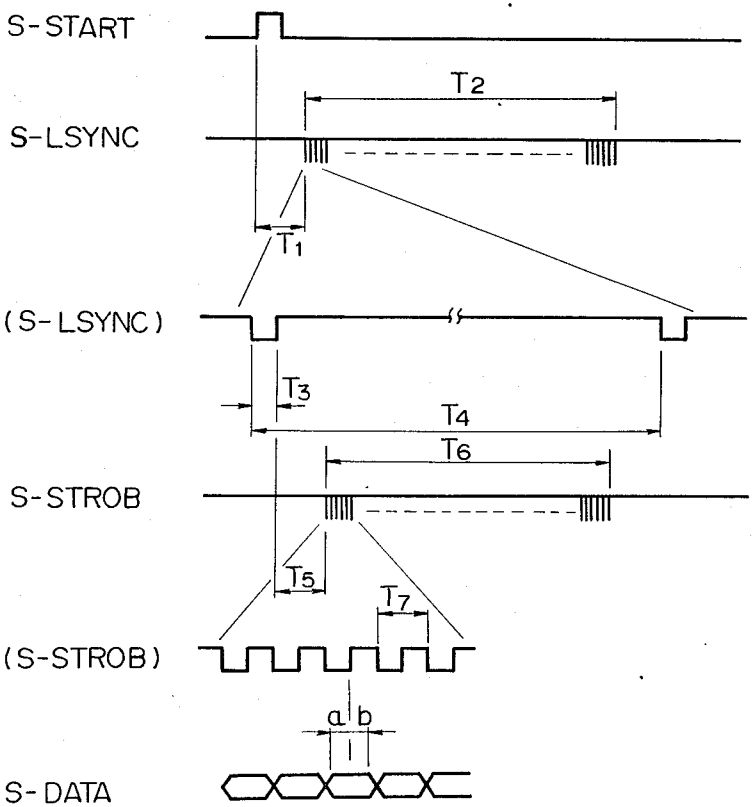
FIGS. 16A to 16F are timing charts useful for explaining the processing.

Specifically, as the device 10 is brought into the READY state, the image scanner 20 delivers an image write start command S-START to the device 10, as shown in FIG. 16A. Upon the lapse of a period of time $T_1$ since the generation of the command S-START, as shown in FIG. 16B, a line sync signal S-LSYNC is continuously delivered for a period of time $T_2$ which corresponds to the number of one frame of lines. As shown in an enlarged scale in FIG. 16C, the signal S-LSYNC has a pulse width of $T_3$ and a pulse interval of $T_4$. As shown in FIG. 16D, a strobe signal S-STROB is fed for a period of time $T_6$ (before the appearance of the next pulse) which corresponds to the number of one line of data, beginning at the instant when a period of time $T_5$ has expired since the leading edge of each pulse of the signal S-LSYNC. As shown in an enlarged scale in FIG. 16E, the strobe signal S-STROB has a pulse duration of $T_7$. As shown in FIG. 16F, image data S-DATA ready out in synchronism with the strobe signal S-STROB are outputted. In FIG. 16F, a is representative of data valid before clock, and b data valid after clock.

The image data S-DATA, line sync signal S-LSYNC and strobe signal S-STROB generated by the image scanner 20 as described above are routed to the video control section 80, as previously mentioned. Those signals are read out of the video control section 80 timed to the transport of the belt 30 and applied to the write head driver 82. As a result, the write voltage is applied to the electrodes **32*a* of the write head 32 to write the images in the belt 30. In this instance, because the belt 30 is driven at a rate corresponding to the density which has been selected by the switch 16*b*, the images are written in the belt 30 with the particular density. Specifically, while the voltage is applied across the third layer or signal electrode 30*c* and the second layer or common electrode 30*b* to cause the corresponding part of the first layer 30*a* to color, the amount of coloring is variable with the duration of the voltage; the shorter the duration of the voltage, the smaller the amount of coloring of the first layer 30*a*** becomes.

Therefore, when the rotation speed of the belt 30 is increased, the belt 30 is moved past the write head 32 within a shorter period of time to in turn shorten the period of time of application of the voltage, resulting in a decrease in the image density. It will be apparent to those skilled in the art that reducing the rotation speed of the belt 30 results in an increase in the image density. Another possible approach to controlling the image density is, for example, varying the value of the write voltage to be applied.

The microcomputer system 64 determines whether the output signal of the home sensor 50 has changed from a low or "L" level to a high or "H" level, i.e., whether the new display area has arrived at the home position. When it has arrived at the home position, i.e., when the display area in which images had been written has reached the display surface 14, the system 64 deenergizes the motor 32 to stop the belt 30. At the same time, the system 64 stops delivering the erase drive pulses E to the erase head driver 78. Subsequently, the system 64 delivers to the image scanner 20 a BUSY signal instead of the READY signal, thereby completing the image writing operation. While the belt 30 is held in a halt, a high impedance is maintained between the second layer or common electrode **30*b* and the needle electrodes 32*a* and erase electrode 34** to prevent interpole current from flowing, thereby preventing the colored condition from being changed.

As described above, in the display device 10, a display member made of an EC material, writing means for writing information in the display member, and erasing means for erasing information which is written in the display member are arranged in such a manner as to be movable relative to each other. This provides the device 10 with not only the capability of copying information which is written by a pen but also the capability of displaying a document and others prepared beforehand, the device 10 serving as a multi-function information board. The preparation for the display requires a minimum of time because it is needless for one to prepare special sheet documents as would be required with a slide projector and an overhead projcetor. In addition, because the display is clearly visible even in a well-lighted room, one can easily see the materials near at hand and writing desired information therein.

Figure 17:
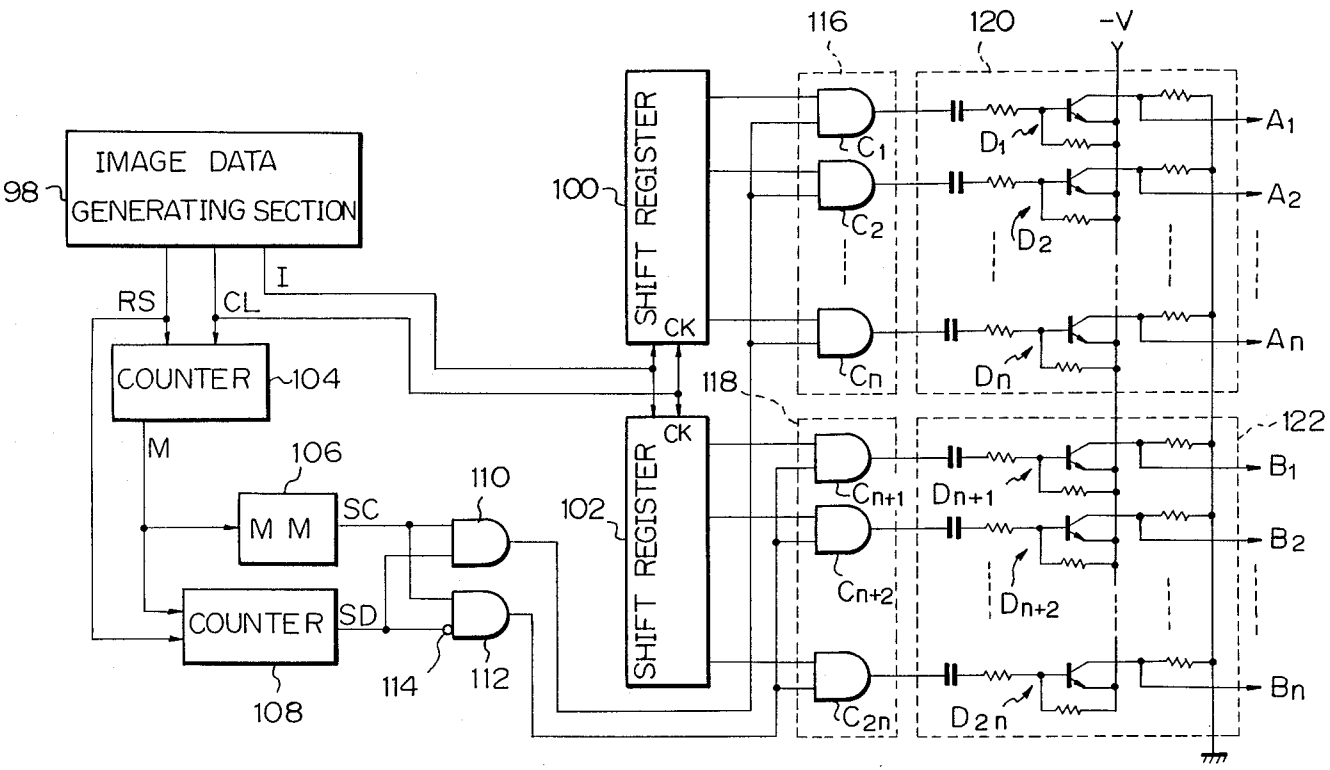
FIG. 17 is a block diagram of a write head drive control section in accordance with another embodiment of the present invention.
Figure 18:
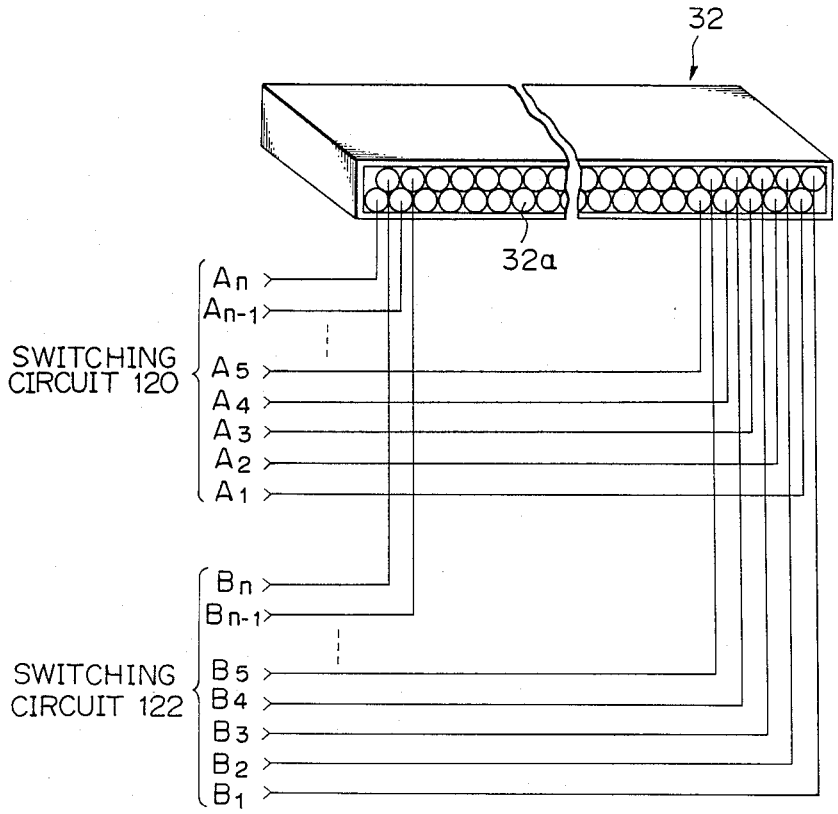
FIG. 18 a schematic view showing wirings to the write head.

Referring to FIGS. 17 and 18, another specific construction of the write head drive control device in accordance with the present invention is shown. In FIGS. 17 and 18, the same or similar structural elements as those of the embodiment described above are designated by like reference numerals.

Referring to FIGS. 17, an image data generating section 98 is adapted to fetch image data from the image scanner so as to produce image data I at a predetermined timing, while producing a reset signal RS and a sampling clock signal CL. The image data I are applied to the input terminals of shift registers 100 and 102 and stored therein every time the sampling clock signal CL, which is also fed from the section 98, arrives at the clock input terminal of the shift registers 100 and 102. Because the electrodes **32*a* of the write head 32 are arranged in two mutually staggered arrays, an arrangement is made such that the sampling clock signal CL is applied to the shift registers 100 and 102 alternately on the basis of the number of electrodes (n) which constitute one array. Hence, the image data are stored in the shift registers 100 and 102** alternately on the basis of n bits.

A counter 104 counts the pulses of the sampling clock signal CL and, as the latter reaches n (number of electrodes in one array), produces an end signal M. Another function of the counter 104 is, every time the reset signal RS from the section 98 is applied, resetting the count and, then, starting counting the pulses again. A monostable multivibrator (MM) 106 begins to produce pulses SC in response to the end signal M which is applied thereto from the counter 104. A counter 108 is reset when the reset signal RS from the section 98 arrives thereat, while inverting an output SD thereof every time the end signal M from the counter 104 arrives thereat. The output pulses SC of the MM 106 are fed to one input terminal of AND gates 110 and 112, and the output SD of the counter 104 are applied to the other input terminal of the AND gate 110 and, via an inverter 114, to the other input terminal of the AND gate 112.

The parallel outputs of the shift register 100 are coupled, respectively, to one input terminal of n AND gates Cj (j=1 to n) which constitute an AND gate group 116. The parallel outputs of the shift register 102 are coupled, respectively, to one input terminal of n AND gates Cj ($j=n+1$ to 2n) which constitute and AND gate group 118. Further, the output of the AND gate 110 is coupled to the other input terminal of the AND gates Cj (j=1 to n) of the AND gate group 116, while the output of the AND gate 112 is coupled to the other input terminal of the AND gates Cj ($j=n+1$ to 2n). The outputs of the n AND gates Cj of the AND gate group 116 are fed, respectively, to n switching circuits Dj (j=1 to n) of a switching circuit group 120 to control them ON and OFF. Likewise, the outputs of the n AND gates Cj of the AND gate group 118 are fed, respectively, to n switching circuits Dj ($j=n+1$ to 2n) of a switching circuit group 122 to control them ON and OFF. When any of the switching circuits Cj of the switching circuit groups 120 and 122 is turned ON, one of drive pulses $A_1$ to $A_n$ and $B_1$ to $B_n$ associated with the switching circuit and representative of a negative voltage −V is applied to a particular one of the needle electrodes 32*a*, as shown in FIG. 18.

In the above construction, the AND gates 110 and 112 are enabled alternately in response to the inverted outputs SD of the counter 108 so as to output the pulses SC from the MM 106 alternately, whereby the AND gates Cj of the AND gate group 116 and those of the AND gate group 118 are enabled alternately. As a result, the n-bit parallel outputs of the shift registers 100 and 102 are applied alternately to the switching circuits Dj of the switching circuit group 120 and those of the switching circuit group 122 via their associated AND gates Cj. This turns ON only those of the switching circuits Dj of the groups 120 and 122 to which black data (ONEs) are applied, so that drive pulses An (n=1 to n) are applied to those electrodes 32*a* which are associated with those particular switching circuits.

By the above procedure, every time the counter 104 generates the end signal M, the drive pulses An and the drive pulses Bn are fed alternately to the two arrays of electrodes 32*a* of the write head 32 (only the electrodes corresponding to black data), thereby writing images in the belt 30. In this construction, the duration of the write voltage applied to any of the electrodes 32*a* of the head 32 is dependent upon the duration of the output pulse SC of the MM 106. Hence, the image density on the belt 30 may be varied by varying the duration of the pulses SC in accordance with the density selected by the switch 16*b*.

In this specific arrangement, the same image data I are stored in the shift register 100 and 102, i.e., write voltages (drive pulses $A_n$ and $B_n$) associated with the same image data are applied to the electrodes 32*a* of the respective arrays of the write head 32, thereby speeding up the image forming operation. Specifically, because the response time of the display belt 30 is 0.05 to 1 millisecond, assuming that the width of the screen is 1.5 meter (1500 millimeters) and the image density is one dot per millimeter, 75 to 150 seconds are necessary for one full screen to be completed. In this regard, when the same write signal is applied to the electrodes 32*a* of the head 32 over two arrays, one full screen is completed within about 30 to 75 seconds; the belt 30 should only be fed at a rate of 20 millimeters per second. It follows that for m rows of electrodes the image forming time is reduced to 1/m.

Figure 19:
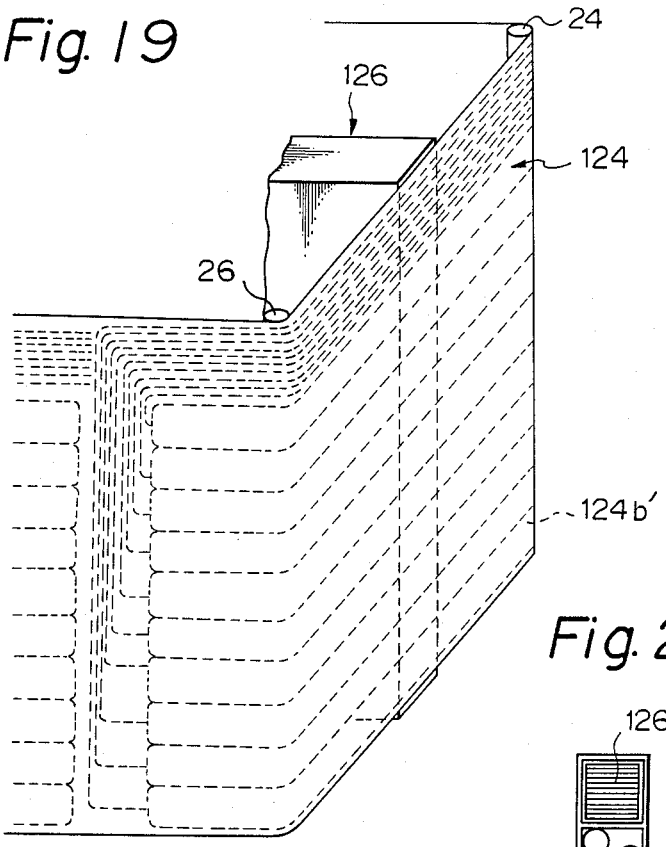
FIG. 19 is a fragmentary perspective view representative of another embodiment of the present invention.

Referring to FIGS. 19 and onward, still another embodiment of the present invention is shown. In those drawings, the same or similar structural elements as those of the foregoing embodiments are designated by like reference numerals.

Briefly, in this particular embodiment, the common electrode of the display belt is divided into a plurality of parts in the widthwise direction of the belt while the needle electrodes of the write head are driven on a block-by-block basis.

Figure 21:
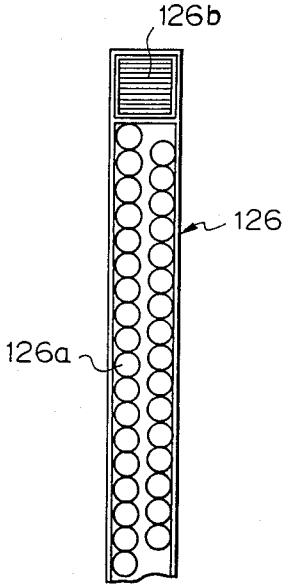
FIG. 21 is a front view of a write head.
Figure 20:
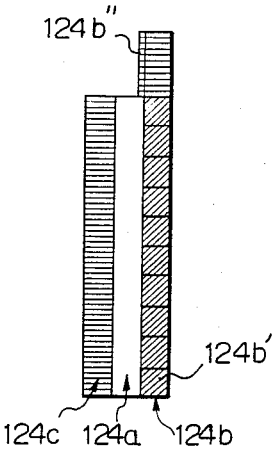
FIG. 20 is a view showing a laminate structure of a display belt.

Referring to FIGS. 19 and 20, a display belt 124, like the belt 30, comprises a first layer 124*a* made of an EC material, a second layer 124 or common electrode 124*b*, and a third layer or signal electrode 124*c*. The second layer 124*b* is divided into a plurality of electrode segments 124'*b* (ten electrode segments in this particular embodiment) in the widthwise direction of the belt 124. Ten common electrode terminals 124''*b* are provided on the belt 124 to apply a voltage to the electrode segments 124'*b*, respectively. Meanwhile, as shown in FIGS. 19 and 21, a write head 126 comprises needle electrodes 126*a* which are arranged in two mutually staggered arrays. Let it be assumed that each array is made up of one hundred electrodes 126*a*. The head 126 further comprises common electrodes 126*b* which are adapted to apply a voltage, respectively, to the common electrode terminals 124''*b* of the belt 124.

Figure 22:
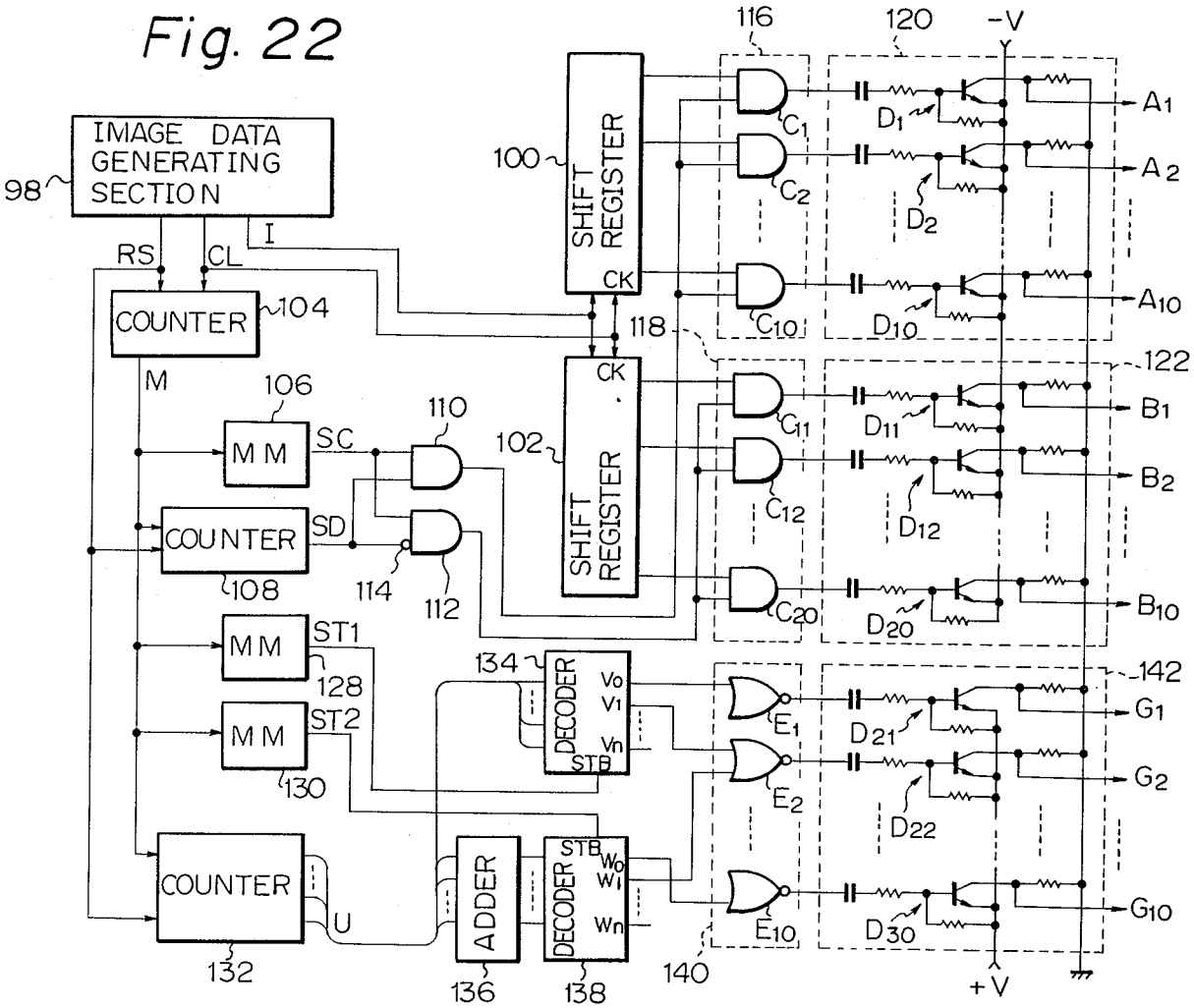
FIG. 22 is a block diagram of a write head drive control section.

Referring to FIG. 22, a specific construction of a drive control device associated with the write head 126 is shown. In FIG. 22, the same or similar structural elements as those shown in FIG. 17 are designated by like reference numerals.

As shown in FIG. 22, monostable multivibrators (MMs) 128 and 130 produce, respectively, strobe pulses ST1 and ST2 in response to the end signal M, which is fed from the counter 104 as previously described. It is to be noted that the strobe pulse ST1 is wider in pulse width than the strobe pulse ST2. A counter 132 produces a binary selection signal U every time the output signal M of the counter 104 is applied thereto, while being reset by a reset signal RS output from the image data generating section 98. An arrangement is made such that the counter 104 generates the end signal M every time it counts ten sampling clock pulses CL. When the selection signal U is fed to a decoder 134, the decoder 134 sequentially makes nine outputs $V_0$ to $V_8$ thereof high or "H" level in response to the strobe pulses ST1 from the MM 128. The selection signal U is also fed to an adder 136. In response to the signal U, the adder 136 adds 1 (one) to the signal U and delivers the sum, i.e., (U+1) to a decoder 138. In response, the decoder 138 sequentially makes nine outputs $W_0$ to $W_8$ thereof high or "H" level when supplied with the strobe signals ST2 from the MM 130.

The outputs $V_0$ to $V_8$ of the decoder 134 are applied, respectively, to one input terminal of NOR gates $E_1$ to $E_9$ out of all the NOR gates Ej (j=1 to 10) which constitute a NOR gate group 140. The outputs $W_0$ to $W_8$ of the decoder 138 are applied, respectively, to the other input terminal of the NOR gates $E_2$ to $E_{10}$ of the NOR gate group 140. The outputs of the NOR gates Ej of the NOR gate group 140 are coupled, respectively, to switching circuits Dj (j=1 to 10) of a switching circuit group 142 to thereby turn ON and OFF the latter.

Figures 23, 24:
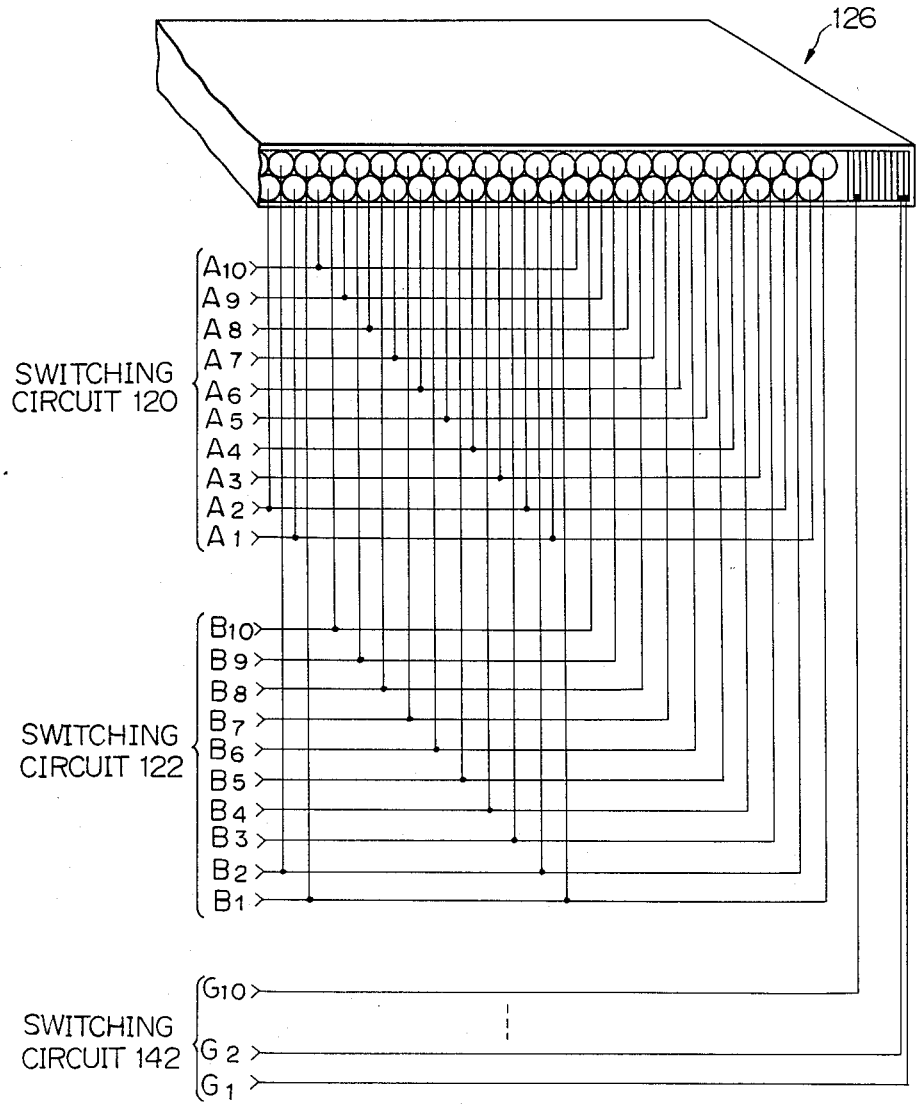
FIG. 23 is a schematic view showing wirings to the write head.
FIG. 24 is a schematic view associated with FIG. 23.

In the circuitry of FIG. 22, the AND gate groups 116 and 118 are made up of AND gates $C_1$ to $C_{10}$ and $C_{11}$ to $C_{20}$, respectively. Likewise, the switching circuit groups 120 and 122 are made up of switching circuits $D_1$ to $D_{10}$ and $D_{11}$ to $D_{20}$, respectively. As shown in FIG. 23, drive pulses $A_1$ to $A_{10}$ from the switching circuit group 120 are fed to each ten consecutive electrodes 126a of the write head 126 which constitute one array. Likewise, drive pulses $B_1$ to $B_{10}$ from the other switching circuit group 122 are fed to each ten consecutive electrodes 126a of the write head 126 which constitute the other array. Further, drive pulses $G_1$ to $G_{10}$ of positive voltage +V are fed from the switching circuits 142 to each ten consecutive common electrodes 126b. Specifically, as shown in FIG. 24, the electrodes 126a of the write head 126 in one array (hereinafter referred to as an array A) are divided into blocks A-1 to A-10 by tens, while those in the other array (hereinafter referred to as an array B) are also divided into blocks B-1 to B-10 by tens.

In the above construction, every time the counter 104 generates the end signal M, two nearby NOR gates Ej (j=1 to 10) sequentially deliver signals which turn ON their associated switching circuits Dj of the switching circuit group 142, whereby the drive pulses Gj are fed to the common electrodes 126b of the head 126. Consequently, the write voltage is sequentially applied to the electrodes 126a of the head 126 block by block. This allows the width of the belt 30, i.e., the display screen broadend. Specifically, so far as the width of the display belt is not greater than about 60 centimeters, it may be controlled by using one shift register for each array as in the circuitry of FIG. 17. However, a display width greater than 60 centimeters cannot be covered by one shift register with ease. By controlling each array of electrodes on a block-by-block basis as stated, it is possible to accomplish the control by use of a single shift register. This allows the screen to be widened without rendering the construction of the write head drive control device complicated.

Hereinafter will be described one embodiment of the image display device of the present invention which is implemented with a photochromic material, with reference made to FIGS. 25 to 31. In these drawings, the same or similar structural elements as those of the foregoing embodiments are designated by like reference numerals.

Figure 25:
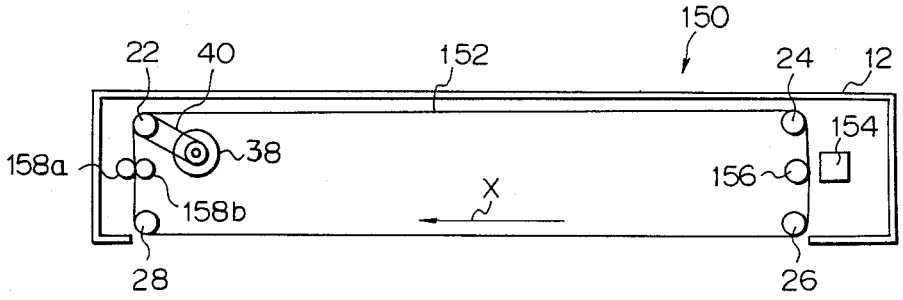
FIG. 25 is view schematically showing the internal arrangement of another embodiment of the present invention.

Referring to FIG. 25, a display device 150 includes the frame 12 in which the drive roller 22 and the idler rollers 24, 26 and 28 are arranged in the same manner as previously stated. An endless belt 152 which serves as a display member is passed over the rollers 22, 24, 26 and 28. A write head 154 is located between the idler rollers 24 and 26 and outside of the belt 152, while a backup roller 156 is located to face the write head 154 with the intermediary of the belt 152. Erase rollers 158a and 158b are disposed between the idler roller 28 and the drive roller 22 and face each other with the intermediary of the belt 152, the rollers 158a and 158b serving as means for erasing information. Again the drive roller 22 is driven by the motor 38 through the belt 40 to in turn drive the display belt 152 in the direction X.

Figure 26:
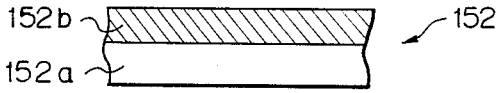
FIG. 26 is a view representative of a laminate structure of display belt which is included in the device of FIG. 25.
Figure 27:
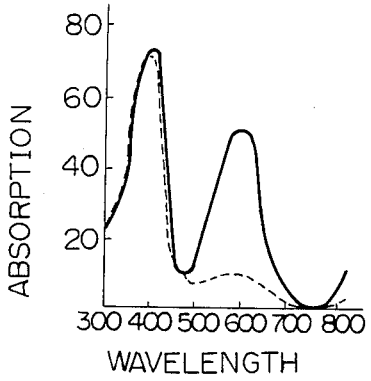
FIG. 27 is a graph showing a characteristic of the belt of FIG. 26.

As shown in FIG. 26, the display belt 152 has a laminate structure made up of a transparent first layer 152a which is formed of an optically reversible photochromic material, and a second layer 152b serving as a reflective layer which is produced by adding a pigment whose color may be, but not limited to, white in a synthetic resin. The first layer 152a is produced by dispersing in a resin, which serves as a binder, an organic photochromic material the molecular structure of which is variable in response to light having particular wavelengths to show a particular absorption characteristic in a particular state and, thereby, record a visible density pattern. In this particular embodiment, the first layer 152a comprises by way of example a dispersion of spiropyran compound in methylmethacrylate methyl; the dispersion showing absorption in response to ultraviolet rays and loosing the absorption in response to heat. In FIG. 27, the light absorption distribution of the photochromic layer before the irradiation by ultraviolet rays and that after the same are represented by a phantom curve and a solid curve, respectively.

In the display belt 152 having the above structure, a visible image can be formed therein by irradiating it by ultraviolet rays through the first layer 152a. Hence, the belt 152 should be passed over the rollers 22, 24, 26 and 28 with the first layer 152a facing outward and the second layer 152b facing inward.

Figure 28:
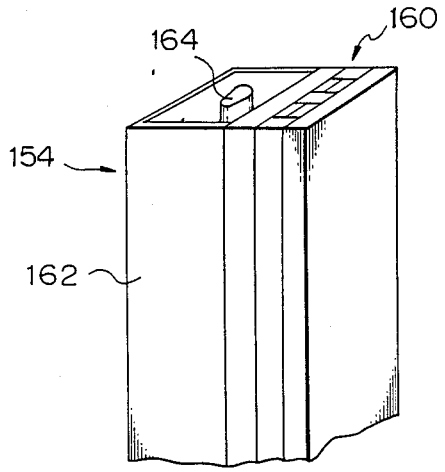
FIG. 28 is a perspective view of a write head.
Figure 29:
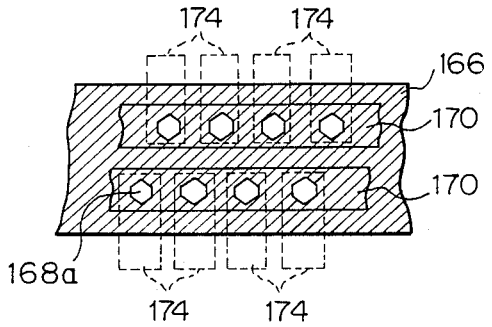
FIG. 29 is a sectional plan view of a liquid crystal shutter array which is included in the write head.
Figure 30:
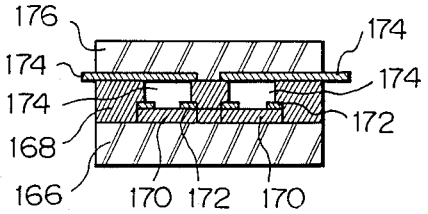
FIG. 30 is a sectional side elevation of the shutter array.

As shown in FIG. 28, the write head 154 comprises a liquid crystal shutter array 160, and a light source 164 received in a housing 162 which is positioned behind the shutter array 160. As shown in FIGS. 29 and 30, the shutter array 160 comprises a substrate 166 formed of transparent glass or the like, and an opaque insulating film 168 deposited on the substrate 166 and formed with two mutually staggered arrays of hexagonal apertures 168a. Row electrodes 170 are laminated on the substrate 166 within the apertures 168a of the insulating film 168, the electrodes 170 thus being arranged in two rows along the arrays of the apertures 168c. A light transmitting plate 172 is provided on each of the row electrodes 170, and a transparent insulating film 174 on the transparent plate 172 and row electrode 170. The insulating films 174 are made of liquid crystal. Signal electrodes 174 are laminated on the opaque insulating film 168 in alignment with the apertures 168a, while another substrate 176 also made of transparent glass or the like is laminated on the signal electrodes 174.

In the shutter array 160 constructed as described above, when a predetermined voltage is selectively applied across the row electrodes 170 and their associated signal electrodes 174, the insulating films 174 made of liquid crystal transmit or intercept light which is incident to the substrate 166. This allows the light to be selectively emitted through the apertures 168a of the insulating film 168. The light source 164 is implemented with a mercury lamp which, as well known in the art, comprises a glass tube with mercury filled therein. A mercury lamp is feasible to photochromic exposure because it emits light containing a considerable amount of ultraviolet rays.

When a voltage is selectively applied across the signal electrodes 174 and the row electrodes 170 in response to information to be written, the ultraviolet rays issuing from the mercury lamp 164 are selectively radiated onto the display belt 152 to write the information in the belt 152.

Each of the erase rollers 158a and 158b previously mentioned is made up of a hollow metal tube with a silicon rubber layer wrapped therearound, and a heater lamp accommodated in the metal tube.

Figure 31:
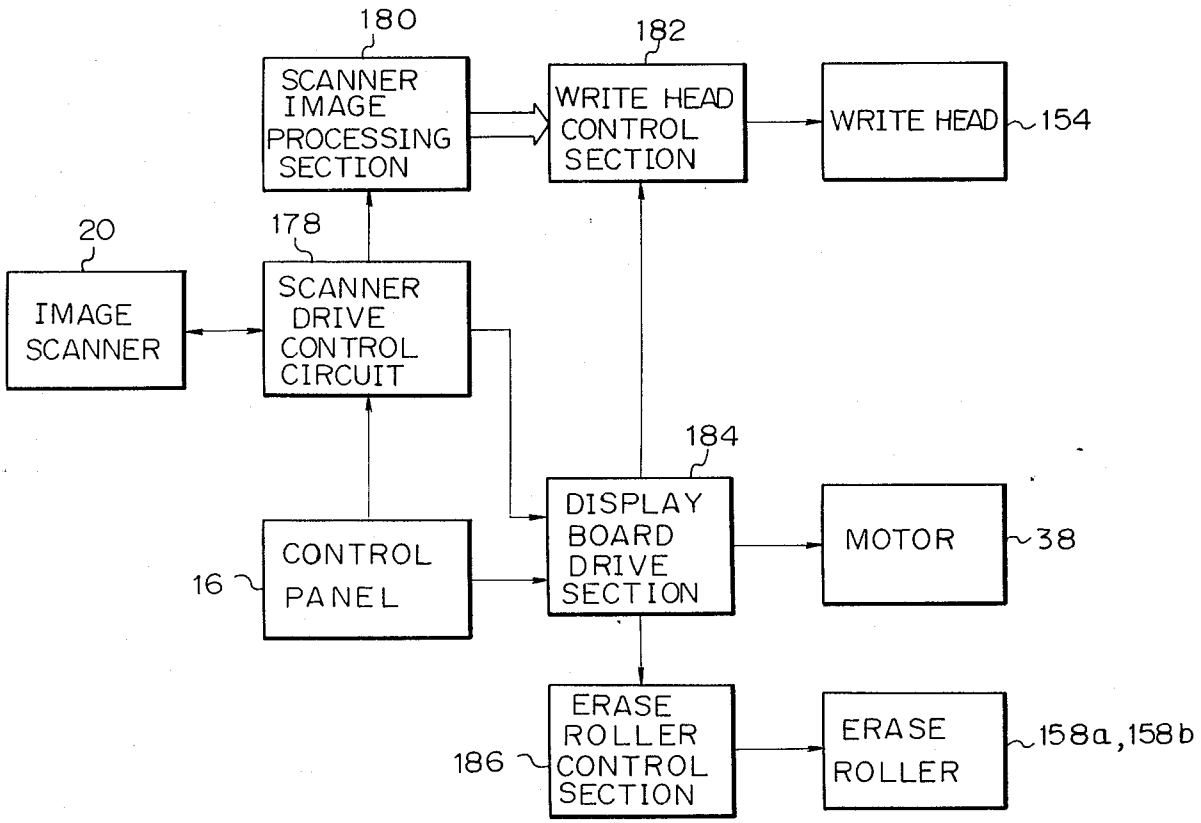
FIG. 31 is a block diagram showing a specific construction of a control section in accordance with the embodiment of 25.

Referring to FIG. 31, a control section of the display device 150 is shown in a block diagram. The control section includes a scanner drive control circuit 178 which responds to the depression of the start switch 16a on the control panel 16 by driving the scanner of the image scanner 20, whereby information read by the scanner 20 is fed to a scanner image processing section 180. In response, the processing section 180 subjects the input information to density conversion and other kinds of image processing so as to match the information to the size of the display area of the display belt 152. The processed information is applied to a write head control section 182 which will be described. The scanner drive control circuit 178 delivers a scanner start signal to a display board drive section 184. Then, the drive section 184 drives the motor 38 to feed the belt 152 and, at a predetermined timing, delivers a write timing signal and an erase timing signal to the write head control section 182 and an erase head control section 186, respectively.

In response to the timing signal from the drive section 184, the write head control section 182 applies the write voltage to the signal electrodes 174 of the shutter array 160 based on input image data, whereby the images read by the scanner 20 are written in the belt 152. The erase roller control section 186, upon reception of the timing signal from the drive section 186, turns on the heater lamps of the erase rollers 158*a* and 158*b* to erase images written in the belt 152.

In operation, initially one of two display areas of the belt 152 constitutes the display surface 14 of the display device 150, as in the foregoing embodiments. It is to be noted that the two display areas of the belt 152 are not physically separated from each other, but are defined by controlling the write timing. As the start switch 16*a* on the control panel 16 is depressed, the display board drive section 184 drives the motor 38 to feed the belt 152 in the direction X as viewed in FIG. 25, until the above-mentioned one display area on the belt 152 enters the frame 12. At this instant, the erase roller control section 186 is supplied with the timing signal from the display board drive section 184 to apply a voltage to the heater lamps of the erase rollers 158*a* and 158*b*, so that the belt 152 is heated to erase information which are stored in the one display area of the belt 152.

At the same time, the image scanner 20 starts scanning a document or the like. The image processing section 180 processes the output image data (line data) of the scanner 20 and delivers the data processed to the write head control section 182. In response to the timing signal from the drive section 184, the control section 182 selectively applies the write voltage to the signal electrodes 174 of the shutter array 160 of the write head 154 based on the image data, thereby sequentially writing the images in the other display surface of the belt 152. When the other surface of the belt 152 mentioned has been aligned with the display surface 14, the drive section 184 deenergizes the motor 38 to bring the belt 152 into a halt. In this manner, the images read by the scanner 20 are displayed on the surface 14 of the display device 150.

As described above, in the display device 150, a display member made of a photochromic material and means for writing information in the display member and means for erasing information written in the display member are disposed to be movable relative to each other.

In the embodiments shown and described, the display member is implemented with a movable endless belt while a write head and an erase head are fixed in place. Alternatively, an arrangement may be made such that the write means and the erase means each comprising a tractor type scanner is movable right and left or up and down at the front or the back of a flat display member, or display panel. In such a case, the write means may be divided into two or more parts and constructed to write image data by use of a particular one of the parts which is closest to a predetermined region or a predetermined write position. Such would effectively shorten the period of time necessary for writing data in the display panel. Furthermore, a tractor type scanner capable of reading information written in the display member and handwritten in the same may be installed to print out the information by use of a printer or the like.

While information may be written by a pen on the display member as in the foregoing embodiments, it may be done so on an image scanner and other image readers instead of or in combination with the display member. Such would allow one to write additional information in the display device at a remote plate from the display device, thereby enhancing efficient operation.

If desired, an edit switch and others may be provided on the display device to allow one to move or delete a part of the information appearing on the device.

Although the foregoing embodiments have been shown and described in relation to an image scanner, it will be apparent to those skilled in the art that the display divice of the present invention may be combined with an office computer, personal computer, image editing system and other various kinds of data processing equipments to display information which is processed by such devices.

The information appearing on the display device may be read and stored in an external storage, e.g. floppy disk.

Further, by suitably selecting the EC material or the photochromic material to be used, mono-color or full-color display is achievable. For example, information may be selectively displayed in different colors such as white, red, blue and yellow which are usually used with a blackboard.

As described above, any of the foregoing embodiments of the present invention provides a multi-function information board.

Next, another embodiment of the present invention which is implemented with a thermoplastic sheet will be described with reference to FIGS. 32 to 36. In these drawings, the same or similar structural elements as those of the foregoing embodiments are designated by like reference numerals.

Figure 32:
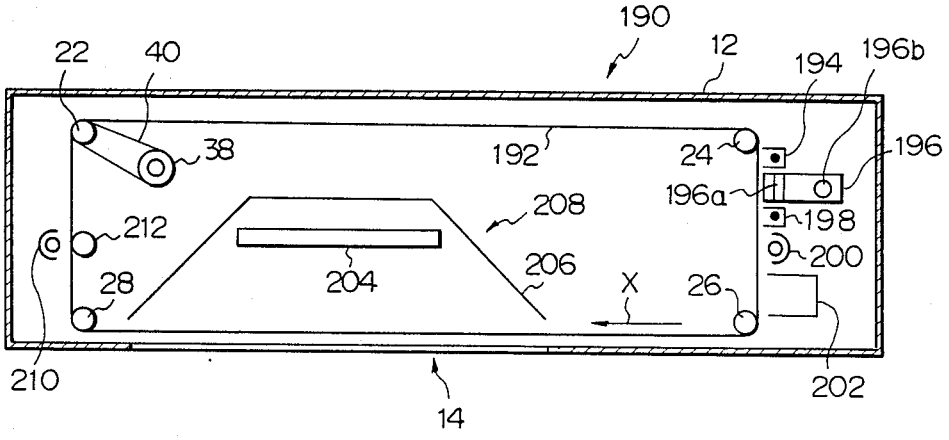
FIG. 32 is a view of the internal arrangement of another embodiment of the present invention.

Referring to FIG. 32, the internal construction of an image display device 190 is schematically shown. As shown, an endless thermoplastic sheet 192 is passed over the drive roller 22 and idler rollers 24, 26 and 28. The drive roller 22 is driven by the motor 38 through the belt 40 to in turn drive the sheet 192 in the direction X. Sequentially disposed between the idler rollers 24 and 26 and adjacent to the sheet 192 are a corona charger (charging means) 194, a liquid crystal shutter head (illuminating means) 196, an AC corona charger (AC charging means) 198, a heater (developing means) 200, and a fan (cooling means) 202. Each of these structural elements 194 to 202 extends over the entire width of the sheet 192.

The corona charger 194 serves to deposit a uniform charge on the thermoplastic sheet 192 by corona discharge. The liquid crystal shutter head 196 comprises an array 196*a* of liquid crystal shutter elements which extends in the widthwise direction of the sheet 192, and a light source 196*b*. The elements of the array are selectively turned ON and OFF based on an image signal and a control signal which are fed thereto from the image scanner 20, so that light issuing from the light source 196*b* is selectively intercepted to expose the sheet 192 to dots of light. The AC corona charger 198 is adapted to neutralize the charge in the unexposed portions of the surface of the sheet 192 by AC corona charge as will be described. The heater 200 heats a thermoplastic resin layer 192c (which will be described) of the sheet 192 to its melting point so as to develop deformative distortions in the exposed portions. The fan 202 solidifies the layer 192c by cooling after the layer 192c has been heated by the heater 200. These consecutive steps are performed while the sheet 192 is transported.

A lamp 204 is located inside the endless sheet 192 to face the display surface 14. A reflector 206 is positioned behind the lamp 204 so that images which are formed in the sheet 192 by the distortions may be effectively illuminated by the lamp 204 to enhance the legibility. The lamp 204 and reflector 206 in combination constitute image displaying means 208.

Further, a heater 210 is positioned between the drive roller 22 and the idler roller 28 and close to the sheet 192 and extends along the width of the sheet 192. The heater 210 functions to re-heat the thermoplastic resin layer 192c of the sheet 192, which has served the display, to its melting point so as to erase the images. A guide roller 212 is provided to promote uniform re-heating by the heater 210.

Figure 33:
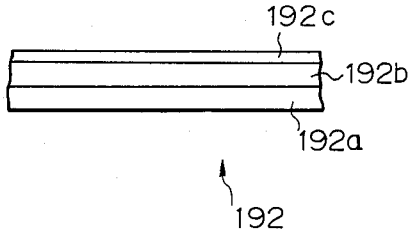
FIG. 33 is a view of a thermoplastic sheet included in the device of FIG. 32.

As shown in FIG. 33, the thermoplastic sheet 192 comprises a laminate structure made up of a transparent conductive film 192a, a photoconductive layer 192b, and the thermoplastic resin layer 192c. The conductive film 192a may be produced by providing a semiconductor film of indium oxide, copper iodide or the like on a polyester film by vacuum deposition and, then, subjecting it to oxidation. The conductive layer 192b is produced by applying to the conductive film 192a PVK (poly-N-vinyl carbazole) with or without TNF (2,4,7-trinitro 9-fluorenone) suitably added thereto. Further, the thermoplastic resin layer 192c is produced by applying stybelite ester-10 or stylene resin to the conductive layer 192b.

In operation, image data are fed from the image scanner 20 (see FIG. 1) to the display device 190 while, at the same time, the display device 190 drives its various sections based on the image data in order to form images therein. Specifically, while the endless sheet 192 is driven by the rollers 22 to 28 in the direction X and at a predetermined rate, the corona charger 194 is energized to deposite a uniform charge on the sheet 192. As the charged sheet 192 is transported over the shutter head 196, the shutter array 196a of the head 196 is selectively turned ON and OFF in response to the image signal with the result that the sheet 192 is irradiated by dots of light line by line at a predetermined timing in the widthwise direction of the sheet 192. In each exposed portion of the sheet 192, the charge concentrates in the interface between the thermoplastic resin layer 192c and the photocnductive layer 192b, so that the surface potential is decreased although the surface charge density is not decreased. In this condition, when the AC corona charger 198 is energized, the induced charge remains in the exposed portions and the electric field is left at the interface while the charge in the unexposed portions is neutralized.

Subsequently, the heater 200 heats the layer 192c of the sheet 192 substantially to its melting point resulting that dot-like deformative distortions (hereinafter referred to as frost) are developed according to the exposure. As the sheet 192 with such frost is cooled by the fan 202, the layer 192c is solidified and the frost is fixed. The resulting one frame of images (hereinafter referred to as frost images) formed continuously are fed to the display surface 14 of the display device. Then, the frost images are illuminated from behind by the lamp 204 to be displayed as images with contrast due to the light scattering effect. After the display of the frost images, the next images begin to be written in the sheet 192 and, at the same time, the sheet 192 is fed. As that part of the sheet 192 which served the display reaches the heater 210, the layer 192c carrying the frost images is heated again to the melting point to erase the images resulting that the surface of the layer 192c becomes smooth to recover the transparency of the sheet 192.

As described above, because a screen which contains frost images is illuminated to provide recognizable contrast on the basis of the light scattering effect of the frost images, a display is visible even in a well-lighted room so that one can comment on the display while looking at a document and others. The screen size may be increased without lowering the luminous intensity because an increase in screen size does not mean an optical enlargement of a document. Further, a document may be read by the image scanner 20 or the like and displayed with ease. This eliminates the need for preparing a special sheet or a slide film which carries desired images thereon, thereby cutting down the time and cost necessary for the preparation of a document.

While the shutter array 196 in this particular embodiment is so constructed as to cover one line of recording width, it is also possible to expose several lines at a time in order to enhance fast recording.

If desired, the shutter head 196 which plays the role of illuminating means may be replaced with an LED array which is turned on and off based on image data.

The image data are not limited to those which are outputted by the image scanner 20 and may even be bit images which are fed from a personal computer and other data processing devices.

In this embodiment, the thermoplastic sheet 192 which have undergone exposure is subjected to AC corona discharge in order to neutralize charge in the unexposed portions. Alternatively, after the exposure, corona discharge may be effected on the sheet 192 to charge it for the purpose of further increasing the amount of charge in the exposed portions and, thereby, the sensitivity of images. Such would be followed by heating the sheet 192 to produce frost images.

Figure 34:
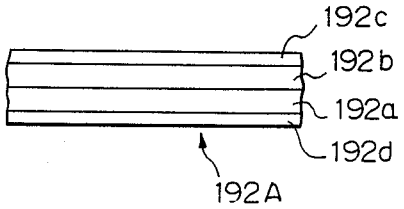
FIG. 34 is a view of another specific structure of the thermoplastic sheet.

Further, while the thermoplastic sheet 192 shown and described transmits light, it may be replaced with a reflection type thermoplastic sheet, as shown in FIG. 34. In FIG. 34, a thermoplastic sheet 192A comprises a white base layer 192d which is applied to the back of the transparent conductive film 192a, in addition to the layers 192c and 192b which are laminated as previously described. The sheet 192A, like the sheet 192 of FIG. 33, is capable of forming frost images therein. As the sheet 192A is illuminated from the front, the white base layer 192d reflects light with different reflectivity due to the light scattering effect of frost images so that the frost images can be displayed with contrast. If desired, the sheet 192d with the white base layer may be replaced with a white conductive film which is prepared by dying a transparent conductive film in white.

Figure 35:
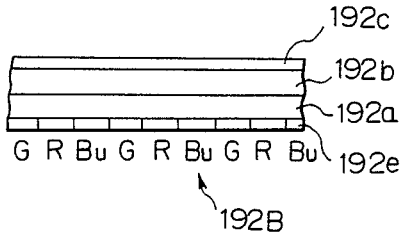
FIG. 35 is a view of a thermoplastic sheet which is provided with a color filter layer.

Referring to FIG. 35, a modification to the thermoplastic sheet of FIG. 33 is shown which is directed to color display. As shown, a thermoplastic sheet 192B comprises the transparent conductive film 192a, the photoconductive layer 192b and thermoplastic resin layer 192c laminated on the film 192a, and a color filter layer 192e provided on the back of the film 192a. The color filter layer 192e may consist of R (red), G (green) and Bu (blue) filters which are arranged consecutively in parallel with the shutter array of the head 196 and each with a predetermined width (e.g. 1 millimeter). In this case, frost images are formed filter by filter in response to image signals which are representative of a color document separated into three colors, i.e., R, G and Bu by a color image scanner or the like. As the frost images are illuminated, those filter portions where frost images are formed become lower in transmittance and, therefore, darker than the others. When looked at a distance, the individual filters on the screen seem very small as a whole so that those light filters which are higher in transmittance are additively mixed together to appear as color images which correspond to a document. This embodiment, therefore, achieves an advantage that a wide screen can be displayed in color, not to speak of the advantages as described in relation to the foregoing embodiments.

Figure 36:
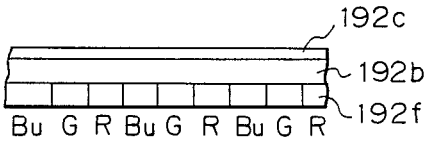
FIG. 36 is a view of a thermoplastic sheet which is provided with dyed conductive stripe filters.

FIG. 36 shows a modification to the structure of FIG. 35. Specically, in FIG. 36, use is made of a conductive film 192f which is produced by dying a transparent conductive film in R, G and Bu each in a stripe configuration.

As described above, in accordance with the embodiments shown and described, frost images based on an image signal are formed in a thermoplastic sheet which consists of a transparent conductive film and a photoconductive material and a thermoplastic resin which are applied to the transparent film, whereby images can be displayed in a wide screen by light which is transmitted through the sheet. This allows a document which is read by an image scanner and others to be displayed directly and repeatedly in a wide screen in a well-lighted room.

Reference will now be made to FIGS. 1 and 37 to 41 for describing an embodiment of a color display device of the present invention which is implemented with a color photochromic sheet. In this particular embodiment, the image scanner 20 of FIG. 1 is assumed to be a color image scanner. In FIGS. 37 to 41, the same or similar structural elements as those shown in FIG. 32 are designated by like reference numerals.

Figure 37:
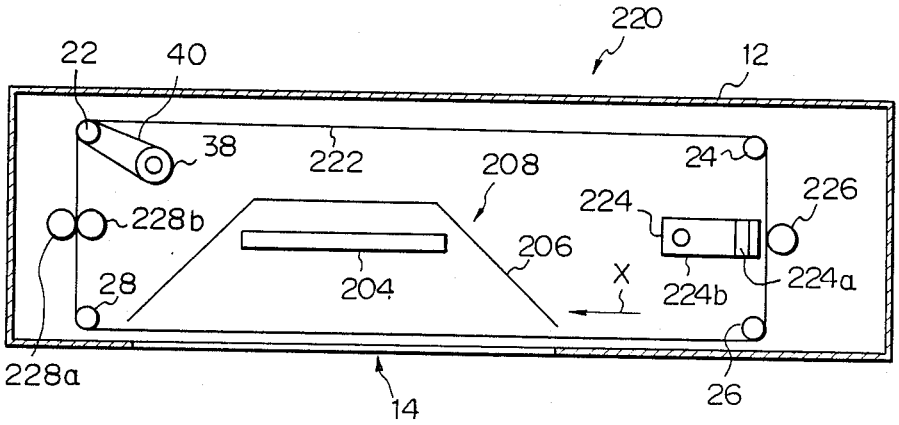
FIG. 37 is a view showing the internal arrangement of one embodiment of a color display device which may also be implemented with the present invention.

Referring to FIG. 37, the internal arrangement of a color image display device 220 is schematically shown. As shown, an endless color photochromic sheet 222 includes a color filter layer 222b which is positioned to face outward, as later described in detail. The sheet 222 is passed over the drive roller 22 and idler rollers 24, 26 and 28. As in the foregoing embodiments, the drive roller 22 is driven by the motor 38 through the belt 40 to in turn feed the sheet 222 in the direction X. Disposed between the idler rollers 24 and 26 and close to the inner surface of the sheet 222 is a liquid crystal shutter array (illuminating means) 224. A backup roller 226 faces the shutter head 224 outside of the sheet 222 so as to cooperate with the shutter head 224 as in the foregoing embodiments. The shutter head 224 comprises an array 224a of liquid crystal shutter elements which extends along the width of the sheet 222, and a light source 224b. The shutter array 224a is selectively turned ON and OFF in response to an image signal and a control signal which are applied thereto from the color image scanner 20, whereby ultraviolet rays issuing from the light source are selectively intercepted to expose the sheet 222. Each of the shutter elements of the array 224a is adapted to form a light dot which is dimensioned 1×1 millimeter. Hence, visible images the absorption of which differs from one dot to another are formed in the sheet 222.

Again, the lamp 204 such as a fluorescent lamp is located to face the display surface 14 while the reflector 206 is positioned behind the lamp 204, the lamp 204 and reflector 206 constituting the image display means 208. Heating rollers 228a and 228b are disposed between the drive roller 22 and the guide roller 28 in such a manner as to hold the sheet 222 therebetween along the width of the sheet 222. The rollers 228a and 228b serve to heat the sheet 222, which has served the display, to thereby erase images. Specifically, the molecular structure of the sheet 222 which shows high absorption and is provided by the radiation of ultraviolet rays is changed by heating to a one which shows high transparency.

Figure 38:
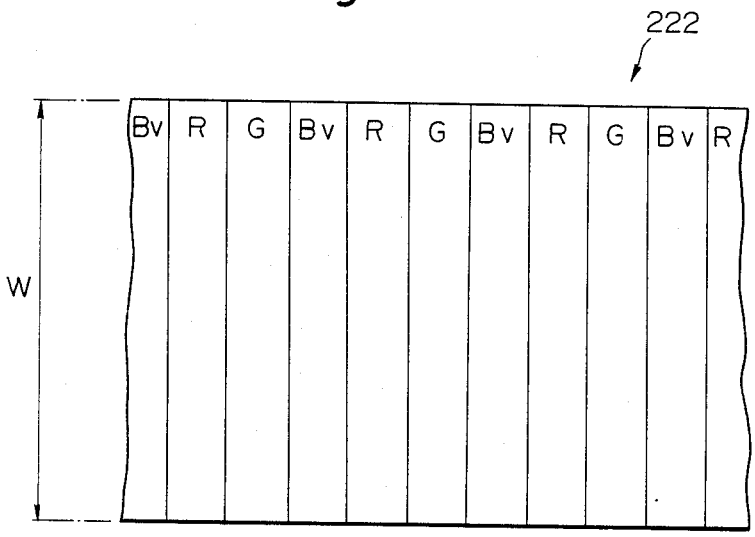
FIG. 38 is a plan view of a color photochromic sheet included in the device of FIG. 37.
Figure 39:
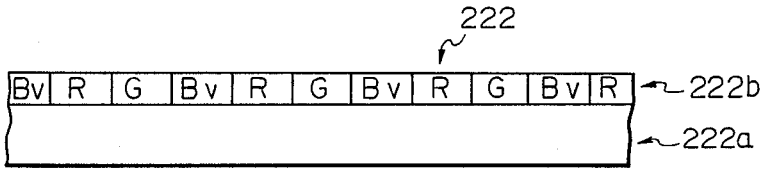
FIG. 39 is a view of the color photochromic sheet.

As shown in FIGS. 38 and 39, the color photochromic sheet 222 is produced by laminating the color filter layer 222b on the photochromic film 222a. The film 222a may be implemented with a dispersion of a spypiran compound, which is an organic photochromic material, in a polymerized methylmethacrylate methyl. The organic photochromic material of the film 222a changes its molecular structure and, therefore, its absorption when exposed to ultraviolet rays. Hence, when ultraviolet rays and other radiations are applied to the film 222a, visible images with different degrees of transmittance are formed in the film 222a. The filter layer 222b comprises a repetitive sequence of R (red), G (green) and Bv (blue) filters each having a 1 millimeter wide stripe configuration.

In operation, image data produced by the color scanner 20 are fed to the color image display device 220. The display device 220 drives its various sections based on the input image data so as to form images therein. Specifically, when an image signal consisting of three separated color components, i.e., R, G and Bv is applied to the device 220, the device 220 positions the color photochromic sheet 222. That is, the device 220 causes the drive roller 22 to feed the sheet 222 until any of the filters of a predetermined color (e.g. R) has been aligned with the shutter array 224a of the head 224. Then, the head 224 is turned ON and OFF on a dot basis in response to the image signal. This is effected selectively for each of the R, G and Bv filters in response to the R, G and Bv components of the image signal and in synchronism with the transport of the sheet 222. Consequently, the sheet 222 is selectively irradiated on a filter basis in accordance with the image signal.

Figure 40:
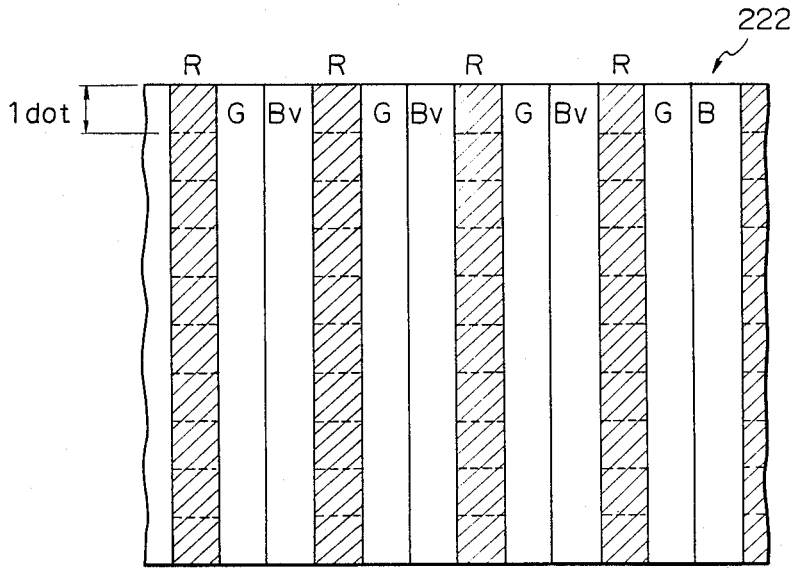
FIG. 40 is a schematic view representative of a particular situation wherein cyan is rendered by the filters of the sheet.

When the sheet 222 is exposed to the light dots filter by filter, one frame of images are completed by the visible images which correspond to the light dots, as previously described. As soon as the resulting continuous images are transported to the display surface 14, they are illuminated from the back of the sheet 222. At this instant, the R, G and Bv dots each being sized 1×1 millimeter appear overlapping each other and, thereby, reproduce various colors by additive mixture. Assume a case wherein, as shown in FIG. 40, only the R filters of the sheet 222 are exposed with the others left unexposed. Then, when the sheet 222 is illuminated from the back, the R filters are lowered in transmittance to appear darker than the G and Bv filters. When observed at a distance which is usual with wide screens as used for lectures and conferences (3 millimeters or so), the stripe filters each being 1 millimeter wide appear very small as a whole while the G and Bv filters which are higher in transmittance appear overlapping each other and are recognized as cyan by additive mixture.

Likewise, when only the G filters of FIG. 40 are exposed, the R and Bv filters are additively mixed to be recognized as magenta; when only the Bv filters are exposed, the R and G filters are mixed and recognized as yellow. In practice, various kinds of colors representative of a document are rendered by varying the mixture ratio on the basis of a dot pattern which is transmitted through the filters. After the display, the next images are written in the sheet 222 and, at the same time, the sheet 222 is transported to between the heating rollers 228*a* and 228*b* to be heated to erase the visible images. The sheet 222 now lost the visible images recovers it transmittance and becomes ready for another use.

In the above-described manner, transmitting light is applied to images which have been formed by exposure in order to reproduce color images on the basis of a difference of transmittance. The advantages attainable with this embodiment are essentially similar to those explained in relation to the display device 190.

The liquid crystal shutter array 224*a* of the head 224 which covers one line of recording width at a time may be replaced with a one which covers several lines at a time so as to expose the R, g and Bv filters simultaneously.

The image data to be fed to the display device is not limited to an image signal from the scanner 20 and may alternatively be color bit images from a personal computer and others.

The light absorption of the color photochromic sheet 222 is variable quantitatively by controlling the intensity of illumination by the shutter array 224*a*. Such may be utilized to render tones in terms of density by varying the transmittance to light.

Figure 41:
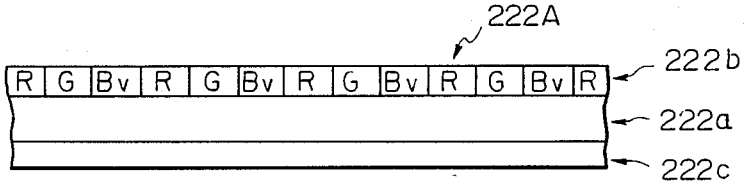
FIG. 41 is a view showing another specific structure of the color photochromic sheet.

The color photochromic sheet in accordance with this particular embodiment may be replaced with the reflection type sheet 222A as shown in FIG. 41. In FIG. 41, the color photochromic sheet 222A is made up of the photochromic film 222*a*, the color filter layer 222*b* provided on the surface of the film 222*a* and in which a group of R, G and Bv filters appear repetitively each in a stripe configuration, and the white base layer 222*c* provided on the back of the film 222*a*. The sheet 222A, like the sheet 222, is capable of forming images based on visible images which are different in absorption. When the sheet 222A with images formed therein is illuminated from the front, the reflectively of light from the base layer 222*c* differs from one visible image to another so that the images are displayed as color images.

As described above, in accordance with this embodiment, images are formed in terms of density and on a filter-by-filter basis in response to an image signal, and the images are illuminated by transmitting light to be displayed in a wide screen. Hence, a document which is read by a color image scanner and others can be displayed directly and repetitively on a wide screen even in a well-lighted room. This contributes a great deal to the office automation which involves the need for a wide screen for display.

Various modifications will become possible for those skilled in the art after receiving the teachings of the present disclosure without departing from the scope thereof.

What is claimed is:

1. An image display device comprising:

a display member formed as an endless belt made of an electrochromic material which electrochemically shows oxidation-reduction reactions, said display member allowing information to be written and erased therein, said display member comprising a first layer made of said electrochromic material, a second layer laminated on one surface of said first layer for constituting a transparent common electrode, and a third layer laminated on the other surface of said first layer and produced by dispersing metal fibers in a polymer, an information source separate from said display member for providing information to be written on said display member;

storage means for storing said information;

driving means for moving said belt at a controlled speed;

writing means for writing information in said display member at a predetermined density dependent on exposure time including voltage applying means for applying a voltage to said display member;

erasing means for erasing information which is written in said display member; and control means for controlling said driving means and said writing means so that said writing means is actuated only when said belt is moving and so that the exposure time of the writing means and the speed of movement of the belt are controlled together to ensure that the information is written at said predetermined density.

2. An image display device as claimed in claim 1, wherein said second layer is divided into a plurality of segments across the width of said belt.

3. An image display device as claimed in claim 2, further comprising optical density specifying means for specifying density, and density adjusting means for varying a duration or a value of the voltage in response to an optical density which is specified by said specifying means.

4. An image display device comprising:

a display member formed as an endless belt made of a photochromic material which is optically reversible, said display member allowing information to be written and erased therein, said display member comprising a transparent first layer made of said photochromic material, and a second layer laminated on one surface of said first layer for constituting a reflecting layer;

an information source separate from said display member for providing information to be written on said display member;

storage means for storing said information;

driving means for moving said belt at a controlled speed;

writing means for writing information in said display member at a predetermined density dependent on exposure time including a light source and shutter;

erasing means for erasing information which is written in said display member; and control means for controlling said driving means and said writing means so that said writing means is actuated only when said belt is moving and so that the exposure time of the writing means and the speed of movement of the belt are controlled together to ensure that the information is written at said predetermined density.

5. An image display device comprising:

a thermoplastic sheet formed as an endless belt consisting of a transparent conductive film, and a photoconductor and a thermoplastic resin which are applied to said film;

an information source separate from said sheet for providing information to be written on said sheet;

storage means for storing said information;

driving means for moving said belt at a controlled speed;

charging means for depositing a uniform charge on said sheet;

illuminating means for selectively illuminating said sheet charged by said charging means in response to said information;

AC charging means for neutralizing the charge in unexposed portions of said film by an AC charge;

developing means for heating said sheet, the unexposed portions of which have been neutralized by said AC charging means, so as to produce images due to deformative distortions which correspond to the image signal at a predetermined density dependent on exposure time;

cooling means for cooling said sheet with the images formed therein so as to fix the images;

image displaying means for displaying frost images by illuminating said sheet; and erasing means for erasing the frost images by heating said sheet after the images have been displayed; and control means for controlling said driving means and said illuminating means, so that said illuminating means is actuated only when said belt is moving and so that the exposure time of the writing means and the speed of movement of the belt are controlled together to ensure that the information is written at said predetermined density.

6. An image display device as claimed in claim 5, wherein said sheet has at least two discrete areas each being capable of displaying images.

7. An image display device comprising:

a color photochromic sheet formed as an endless belt consisting of a photochromic film absorption of which changes in response to light having predetermined wavelengths, and a repetitive sequence of color filters of red, green and blue which are provided on said photochromic film each in a stripe configuration;

an information source separate from said sheet for providing information to be written on said sheet;

storage means for storing said information;

driving means for moving said belt at a controlled speed;

illuminating means for selectively illuminating said respective filters of said sheet by light having predetermined wavelengths on a pixel basis in response to said information, thereby forming images at a predetermined density dependent on exposure time which are different in absorption from each other;

image displaying means for displaying the images formed in said sheet as color images by illuminating said sheet;

erasing means for erasing said images by heating said sheet after the images have been displayed; and control means for controlling said driving means and said illuminating means so that said illuminating means is actuated only when said belt is moving and so that the exposure time of the writing means and the speed of movement of the belt are controlled together to ensure that the information is written at said predetermined density.

8. An image display device as claimed in claim 7 wherein said sheet has at least two discrete display areas each being capable of displaying images.

9. An image display device as claimed in claim 1, wherein said information source is an image scanner.

10. An image display device as claimed in claim 1, further comprising an encoder driven by said driving means and connected to said control means for determining the position of the belt.

* * * * *